US010807263B2

(12) United States Patent
Busch et al.

(10) Patent No.: US 10,807,263 B2
(45) Date of Patent: Oct. 20, 2020

(54) FLEXIBLE CURVILINEAR KNIFE

(71) Applicant: The Procter & Gamble Company, Cincinnati, OH (US)

(72) Inventors: James William Busch, Maineville, OH (US); Jennifer Lynn Tuertscher, Guilford, IN (US); Stephen Douglas Congleton, Loveland, OH (US); Dale Francis Bittner, Harrison, OH (US); Matthew Ryan Wortley, Trenton, OH (US)

(73) Assignee: The Procter & Gamble Company, Cincinatti, OH (US)

( * ) Notice: Subject to any disclaimer, the term of this patent is extended or adjusted under 35 U.S.C. 154(b) by 127 days.

(21) Appl. No.: 15/446,378

(22) Filed: Mar. 1, 2017

(65) Prior Publication Data

US 2018/0154533 A1 Jun. 7, 2018

Related U.S. Application Data

(63) Continuation-in-part of application No. 15/371,596, filed on Dec. 7, 2016, now Pat. No. 10,471,620.

(51) Int. Cl.

| | |
|---|---|
| ***B26D 7/26*** | (2006.01) |
| ***B26D 1/00*** | (2006.01) |
| ***B26D 1/40*** | (2006.01) |

(52) U.S. Cl.

CPC ..... *B26D 1/0006* (2013.01); *B26D 1/405* (2013.01); *B26D 7/2614* (2013.01); *B26D 2001/006* (2013.01); *B26D 2001/0053* (2013.01)

(58) Field of Classification Search

CPC .... B26D 1/0006; B26D 1/405; B26D 7/2614; B26D 7/26; B26D 1/00; B26D 1/40; B26D 2001/006; B26D 2001/0053

USPC ..... 83/698.31, 332, 335, 331–349, 582–583

See application file for complete search history.

(56) References Cited

U.S. PATENT DOCUMENTS

| | | | | |
|---|---|---|---|---|
| 3,198,093 | A | 8/1965 | Kirby et al. | |
| 4,444,080 | A | 4/1984 | Schulz | |
| 4,785,697 | A | 11/1988 | Gherardi | |
| 4,945,798 | A | 8/1990 | Alphenaar | |
| 5,125,302 | A | 6/1992 | Biagiotti | |
| 5,653,399 | A | 8/1997 | Koutonen et al. | |
| 5,775,194 | A * | 7/1998 | Spada | B26D 7/2614 493/371 |

(Continued)

FOREIGN PATENT DOCUMENTS

| | | | |
|---|---|---|---|
| EP | 0555190 | A2 | 8/1993 |
| EP | 2067584 | A1 | 6/2009 |
| WO | WO200146053 | A1 | 6/2001 |

OTHER PUBLICATIONS

U.S. Appl. No. 15/371,596, filed Dec. 7, 2016 Bittner, et al.

*Primary Examiner* — Evan H MacFarlane
*Assistant Examiner* — Nhat Chieu Q Do
(74) *Attorney, Agent, or Firm* — C. Brant Cook

(57) ABSTRACT

A flexible curvilinear knife is disclosed. The flexible curvilinear knife is formed from a cutting element, a blade holder element, and a plurality of spring elements. A first, proximal end of each spring element of the plurality of spring elements is operably and fixably attached to a discrete location of the cutting element and a second, distal end of each spring element of the plurality of spring elements is fixably attached to a discrete location of the blade holder element.

9 Claims, 28 Drawing Sheets

(56) References Cited

U.S. PATENT DOCUMENTS

| | | | | |
|---|---|---|---|---|
| 5,918,518 | A | 7/1999 | Kobayashi et al. | |
| 6,058,817 | A | 5/2000 | Kobayashi et al. | |
| 6,422,113 | B1 | 7/2002 | Blume | |
| 6,431,491 | B1 | 8/2002 | Biagiotti | |
| 6,742,427 | B2 | 6/2004 | Buta | |
| 8,440,043 | B1 | 5/2013 | Schneider et al. | |
| 8,617,162 | B2 * | 12/2013 | Steinwachs | A61B 17/1604 606/79 |
| 8,679,141 | B2 * | 3/2014 | Goodin | A61B 17/320016 606/159 |
| 9,364,965 | B2 | 6/2016 | Schneider et al. | |
| 2006/0123959 | A1 * | 6/2006 | Bocast | B23D 61/006 83/13 |
| 2008/0148913 | A1 * | 6/2008 | Chen | G01N 1/06 83/23 |
| 2012/0245011 | A1 | 9/2012 | De Matteis | |
| 2014/0345434 | A1 * | 11/2014 | Scattolin | B26D 1/0006 83/676 |
| 2015/0272205 | A1 * | 10/2015 | Beckmann | A24C 5/473 131/58 |
| 2016/0263760 | A1 | 9/2016 | Schneider et al. | |

* cited by examiner

FLEXIBLE CURVILINEAR KNIFE

FIELD OF THE INVENTION

The present disclosure generally relates to equipment for cutting web materials during the formation of assembled finished products. The present disclosure also relates to knives used to cut elongate web materials suitable for the formation of assembled products such as diapers, catamenial devices and adult incontinence articles and consumer products such as bath tissue, paper toweling, facial tissues, and hard surface cleaning articles. The present disclosure also relates to knives suitable for perforating elongate web materials suitable for the formation of consumer products such as bath tissue and paper toweling. More particularly, the present disclosure also relates to knives used to provide curvilinear cuts for elongate web materials suitable for the formation of assembled products such as diapers, catamenial devices and adult incontinence articles. Further, the present disclosure also relates to knives used to provide curvilinear perforations for elongate web materials suitable for perforating elongate web materials suitable for the formation of consumer products such as bath tissue and paper toweling.

BACKGROUND OF THE INVENTION

Manufacturing of products and packages often requires transforming a continuous flat web of material into individual products and packages. For example, soluble unit dose fabric and dish care pouches are formed from flat webs of water soluble film that are converted into three dimensional pouches by shaping and assembling layers of film. Similarly, diapers, sanitary napkins, wipes, bandages, and the like are formed by layering multiple flat webs of material upon one another and cutting the layered webs to form individual products comprised of multiple layers of material.

As a web passes through a nip between a press and an anvil, a cutting knife strikes and cuts the web. To provide for a consistently complete cut of the web in the cross direction, the rotary press and anvil are set so that there is interference between the cutting knife and the anvil. That is, the rotary press and anvil are set so close to one another that cutting knife must slightly deform to permit the rotary press and the anvil to counter rotate with one another. For instance the knife may have a height of 40 mm and the peripheral surfaces of the rotary press and anvil are set such that they are only 39.9 mm apart. Thus, when the web of material is fed through the nip between the rotary press and the anvil, deformation or movement of 0.1 mm must be provided to permit the knife to pass through the nip between the surface of the rotary press and the anvil.

Ordinarily, most of the deformation is desirably provided by deformation of the knife as opposed to deformation or movement of the rotary press and or anvil. Movement of the axes of rotation of one or both of the rotary press and or anvil could result in a loss of control of movement of the web and fatigue of parts of expensive precision machine equipment. Typically anvils are formed of solid hardened material such as steel and little peripheral deformation occurs under typical cutting loads and stresses.

Since by design the knife accommodates most of the interference, the knife is loaded and unloaded each time the web is cut in the machine direction. Operators of converting lines loath having their lines shut down for maintenance. Accordingly, they try to design cutting systems on such converting lines to operate for extended periods with a minimal amount of down-time for maintenance. Ideally, operators would like to be able to make millions of cuts, and thus load and unload the knife millions of times, without shutting down the converting line. Loading and unloading of a knife mounted on a rotary press millions of time can result in fatigue of the knife, which ultimately can lead to failure of the knife. One technique for reducing fatigue in rotary cutting knives is to mount the cutting knife on the rotary press at an angle relative to the anvil so that the interference is accommodated by bending of the knife. A disadvantage of mounting a knife as such is that a variable speed rotary press operating at low speed may be needed to cut webs that are formed into three-dimensional shapes, such as for soluble unit dose fabric and dish care pouches.

By way of example, and as shown in FIGS. 1 and 1A, webs of material can be cut in the cross-machine direction by passing the web material through the nip of an exemplary prior art rotary cutting apparatus 1020 formed by a rotary cutter 1028 and an anvil 1050 collinearly disposed thereto to form individual products 1092. A simplified cutting apparatus 1020 can include a rotary cutter 1028 having an axial-direction 1022, a radial-direction 1024 and a circumferential-direction (also "machine direction") 1026. The rotary cutter 1028 has an outer peripheral surface 1032 and includes a rotary shaft member 1030. At least one linear knife member 1036 is operatively joined to the shaft member 1030. At least a portion of the knife member 1036 can extend axially along the shaft member 1030 and can extend radially outward from the shaft member. In particular aspects, at least one and desirably at least a pair of axially spaced-apart, peripheral bearing members 1040 are joined to the rotary shaft member 1030. Additionally, at least an operative portion of each peripheral bearing member 1040 extends radially outward from the shaft member 1030 and extends circumferentially about the shaft member.

The exemplary prior art apparatus can include rotating a rotary cutter 1028 which has provided an outer peripheral surface 1032 and has included a rotary shaft member 1030. At least one knife member 1036 has been joined to the shaft member 1030. At least a portion of the knife member 1036 can extend axially along the shaft member 1030, and can extend radially outward from the shaft member. In particular aspects, at least one and desirably at least a cooperating pair of axially spaced-apart peripheral bearing members 1040 have been joined to the rotary shaft member 1030. At least a portion of each peripheral bearing member 1040 can extend radially outward from the shaft member 1030, and can extend circumferentially around the shaft member.

The knife member 1036 can be substantially and fixedly attached to the rotary shaft member 1030. The cutting method and apparatus can further include at least one crimping or other bonding member. The bonding member can be operatively joined to the rotary shaft member 1030, and can be located proximate the knife member 1036 and positioned circumferentially adjacent the knife member 1036.

The exemplary prior art apparatus can further include an anvil 1050 which has been configured to cooperate with the rotary cutter 1028 to provide an operative cutting region 1056 which is located in a region between the rotary cutter 1028 and the anvil 1050. The anvil 1050 can be provided by any operative component structure or mechanism. The anvil 1050 can have a substantially smooth anvil surface, or may have a patterned anvil surface. For example, the cooperating anvil surface can include an array of anvil elements or members that cooperatively match a pattern of cutting elements or members that are located on the rotary cutter 1028. As representatively shown, the anvil 1050 can be a rotary anvil which is operatively rotatable about an anvil axis of rotation and positioned operatively adjacent the rotary cutter 1028. The anvil can be configured to counter-rotate relative to the rotary cutter 1028, and the cutting region 1056 can be provided in a nip region that is positioned between the rotary cutter 1028 and the counter-rotating anvil 1050. Accordingly, the product web 1060 can operatively move at a selected cutting speed through the nip region 1056.

As shown in FIG. 1B, webs of material can be cut in the cross-machine direction by passing the web material through the nip of an exemplary prior art rotary cutting apparatus 1020 formed by a rotary cutter 1028 having at least one curvilinear knife member 1036A operatively joined thereto and an anvil 1050 collinearly disposed thereto to form individual products 1092A. The expanded view shown in FIG. 1C provides an exemplary understanding of the forces exerted upon the curvilinear knife member 1036A as the curvilinear knife member 1036A progresses through the cutting region 1056 formed by the curvilinear knife member 1036A and the anvil 1050 with product web 1060 disposed therebetween.

In order to provide a complete cut and sever the product web 1060 to form individual products 1092A, the curvilinear knife member 1036A must necessarily be contactingly and forcibly engaged with the surface of anvil 1050. As shown in FIGS. 1D and 1E, as knife member 1036A incrementally engages anvil 1050, there is a localized deformation of the portion of knife member 1036A in contact with anvil 1050. This can be observed in the Z-direction compression of the knife member 1036A. By way of example, if knife member 1036A is provided with a constant and nominal Z-direction thickness, x, at the point of contact of knife member 1036A with anvil 1050, the knife member 1036A is compressed in a localized region of knife member 1036A. This localized compression is generally believed to be localized only to that region where the knife member 1036A is contactingly engaged with anvil 1050.

One of skill in the art will recognize that many forms of deformation of knife member 1036A due to compressionary forces can occur. Without desiring to be bound by theory, one such type deformation caused by compression of the knife member 1036A with anvil 1050 can cause a localized decrease in the nominal Z-direction thickness of knife member 1036A, the material forming knife member 1036A must necessarily deform out of the Z-direction plane. As shown in FIG. 1E, the out-of-plane deformation from the Z-direction would likely result in material being deformed in the CD. If the material forming knife member 1036A is provided with a nominal thickness y, the out-of-plane deformation from the Z-direction is shown as a displacement $\Delta y$ in the CD.

One of skill in the art will readily appreciate that repeated out-of-plane deformation of the knife member 1036A in the CD can result in rapid degradation of the cutting surface of knife member 1036A. Additionally, it is believed that repeated out-of-plane deformation of the knife member 1036A in the CD can result in material fatigue in the knife member 1036 itself. As one of skill in the art will readily appreciate, material fatigue in the knife member 1036 could result in catastrophic destruction of the knife member 1036A. This result could require replacement of the knife member 1036A with a new knife member 1036A, or the removal of metal shards from the product being cut by rotary cutting apparatus 1020, or worse yet, the removal of metal shards from the operator of rotary cutting apparatus 1020.

Additionally, current manufacturing processes can require a large degree of set-up in order to provide the exact interference required by the web material to be cut and the equipment that will be used to cut it. It is believed that current manufacturing techniques may require an interference on the order of 1.0 μM to 9.0 μM in order to effectively cut a web material for use as an assembled product such as a diaper, catamenial device, or adult incontinence article. Having the ability to decrease the overall set-up time of a web cutting operation by allowing the operator to place the knife/anvil system in a position without an exacting degree of accuracy and provide the desired degree of interference between the anvil and blade would be highly desirable.

In order to overcome these significant drawbacks, it would be beneficial to incorporate the various aspects, features and configurations, alone or in combination, of the apparatus and method of the present invention in order to more efficiently and more effectively cut a product web. The apparatus and method can more reliably maintain the effectiveness of the cutting knives, and can more efficiently conduct the cutting operation at lower cost. The cutting operation can more efficiently be coordinated and/or combined with other manufacturing operations, such as a bonding operation. In particular aspects, the bonding operation can provide a crimping or sealing of the product web. As a result, the method and apparatus of the present invention can help eliminate the need for additional processing equipment, and can help reduce manufacturing costs. Additionally, the method and apparatus of the present invention can help eliminate any potentially catastrophic and/or even dangerous material degradation resulting in equipment failure or injury-in-fact. In short, with the above limitations in mind, there is a continuing unaddressed need for a rotary press knife that has a long fatigue life. Surprisingly, the apparatus and process of the present invention improved the fatigue lifetime of the knife.

SUMMARY OF THE INVENTION

The present disclosure provides for a flexible curvilinear knife. The flexible curvilinear knife is formed from a cutting element, a blade holder element, and a plurality of spring elements. A first, proximal end of each spring element of the plurality of spring elements is operably and fixably attached to a discrete location of the cutting element and a second, distal end of each spring element of the plurality of spring elements is fixably attached to a discrete location of the blade holder element.

DETAILED DESCRIPTION OF THE INVENTION

"Machine Direction" or "MD", as used herein, means the direction parallel to the flow of the fibrous structure through the papermaking machine and/or product manufacturing equipment. "Cross Machine Direction" or "CD", as used herein, means the direction perpendicular to the machine direction in the same plane of the fibrous structure and/or fibrous structure product comprising the fibrous structure. "Z-direction" as used herein, is the direction perpendicular to both the machine and cross machine directions.

Figure 1:
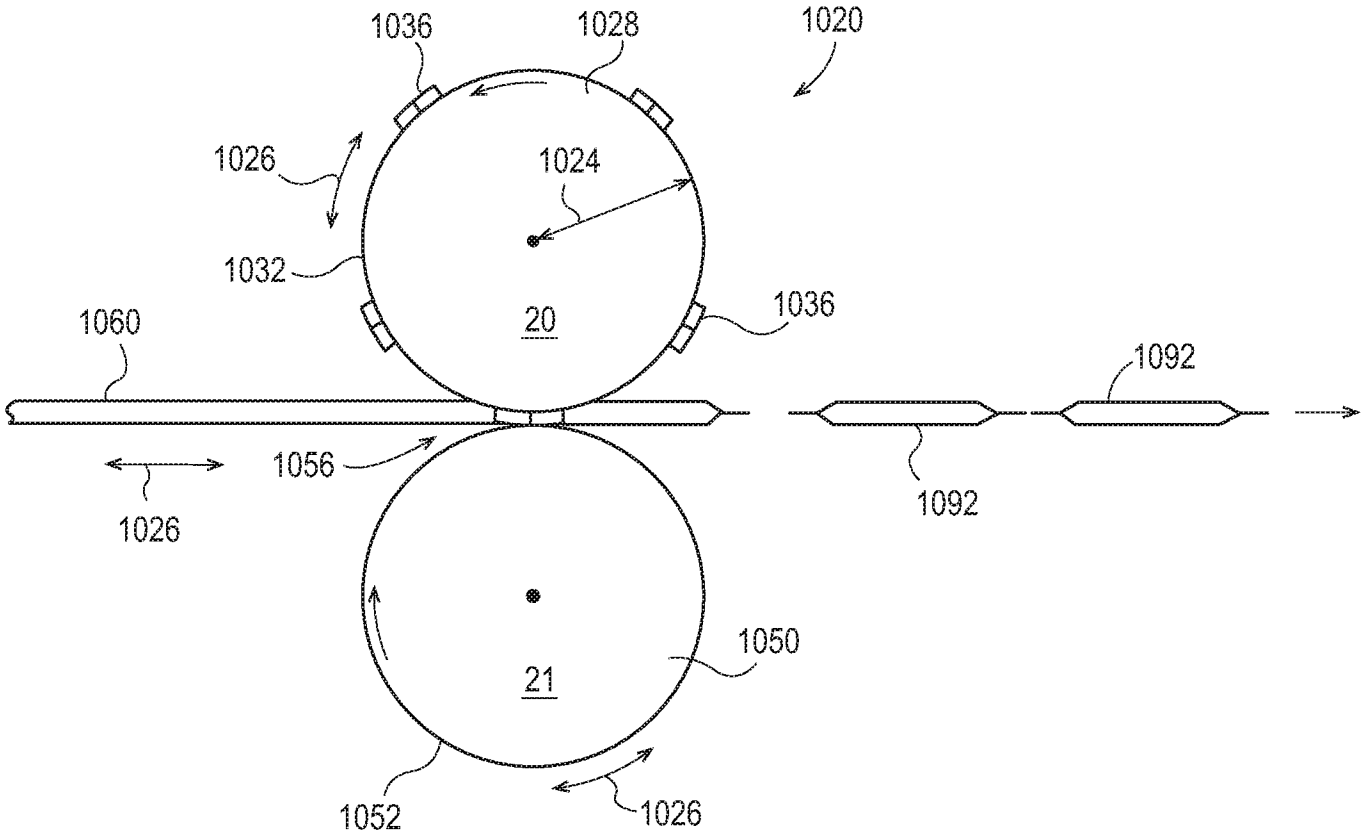
Fig. 1 (PRIOR ART)
FIG. 1 is a plan view of an exemplary prior art apparatus for cutting a web material.
Figure 1A:
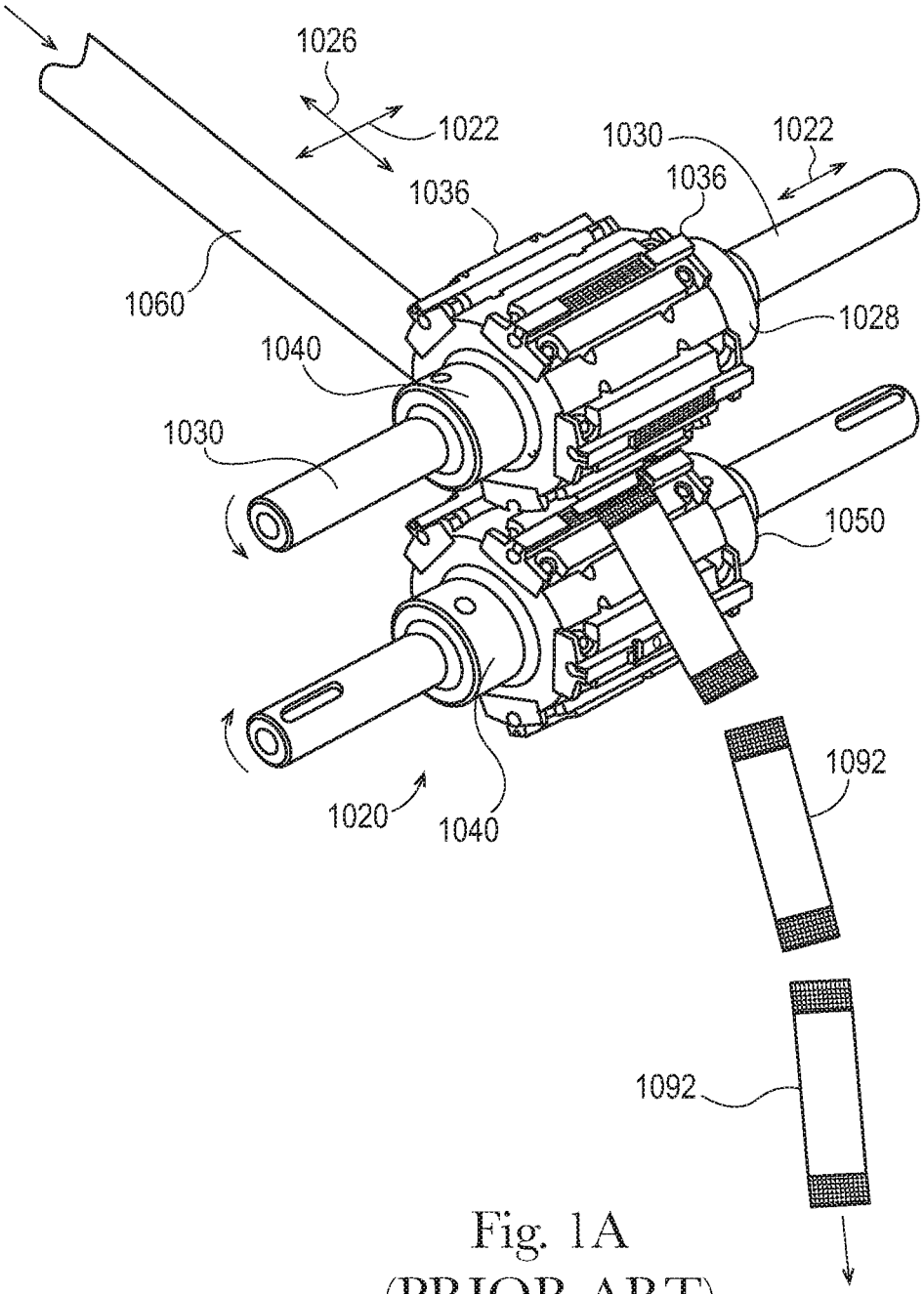
Fig. 1A (PRIOR ART)
FIG. 1A is a perspective view of an exemplary prior art apparatus for cutting a web material where the knife member is linear.
Figure 1B:
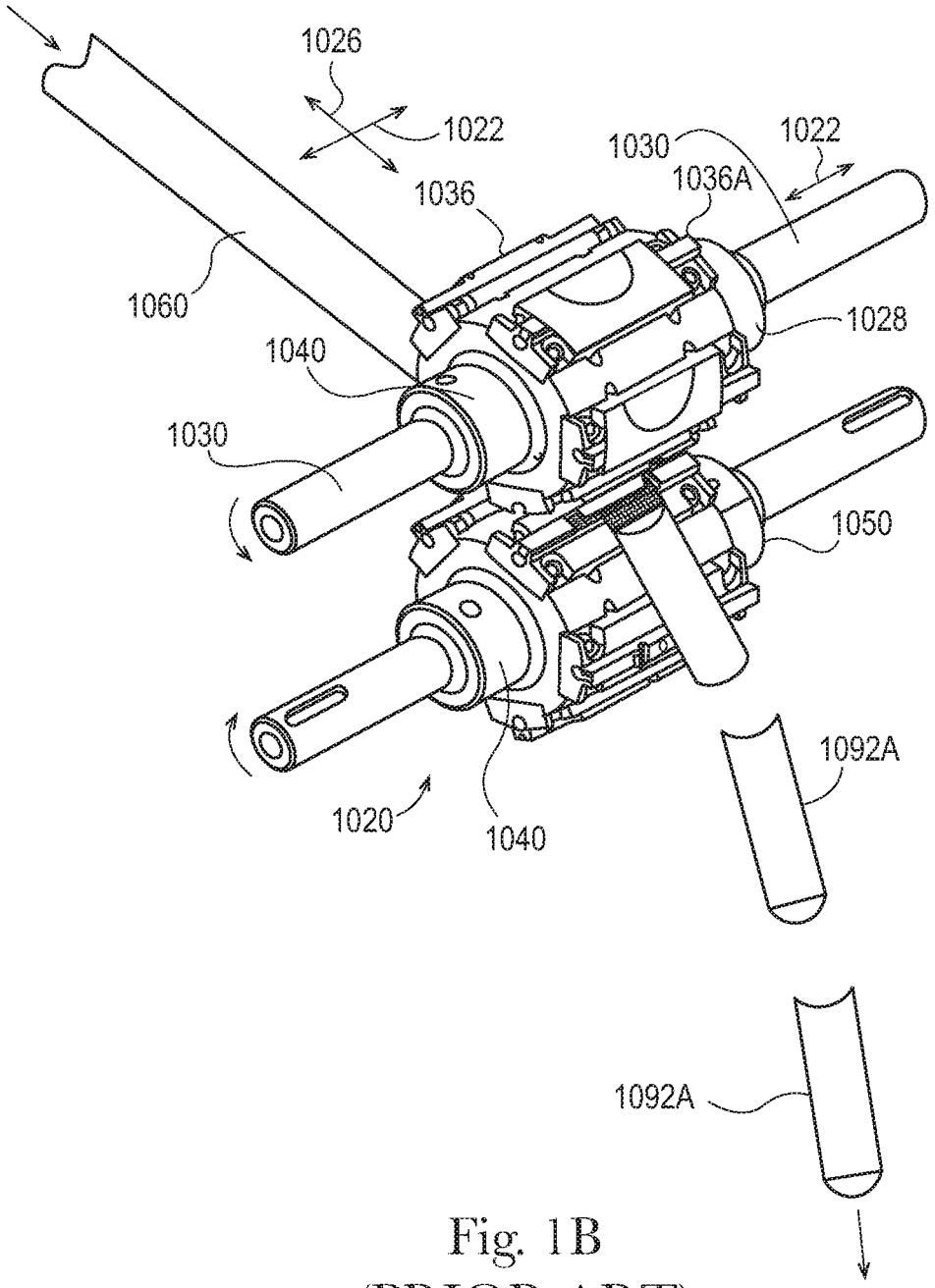
Fig. 1B (PRIOR ART)
FIG. 1B is a perspective view of an exemplary prior art apparatus for cutting a web material where the knife member is curvilinear.
Figure 1C:
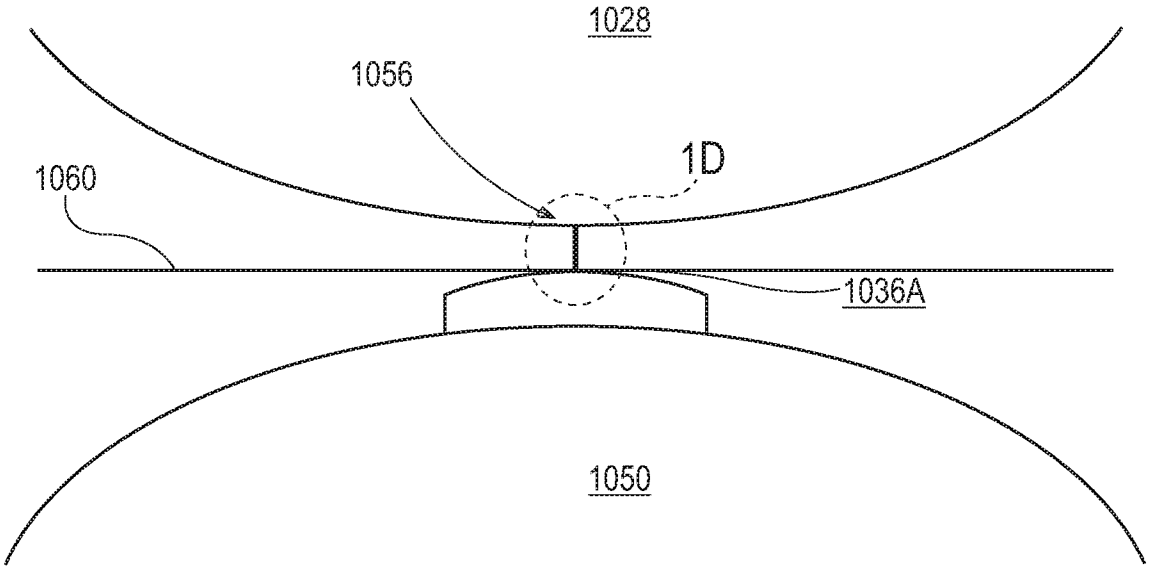
Fig. 1C (PRIOR ART)
FIG. 1C is an expanded plan view of the region of the exemplary prior art apparatus for cutting a web material of FIG. 1B where the knife member engages an anvil when a web material is disposed therebetween.
Figure 1D:
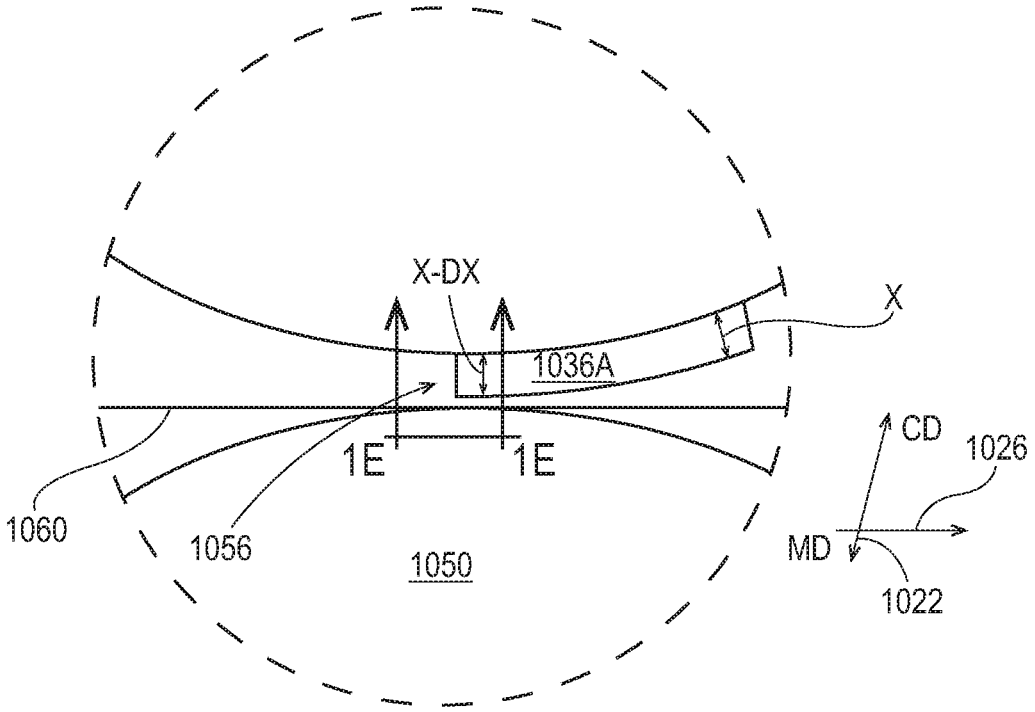
Fig. 1D (PRIOR ART)
FIG. 1D is a further expanded view of the region labeled 1D of FIG. 1C.
Figure 1E:
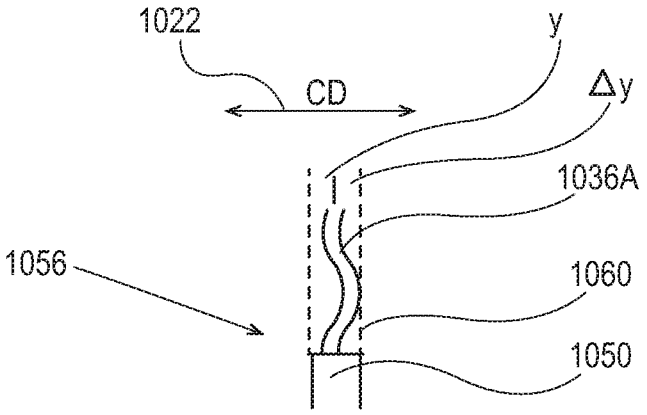
Fig. 1E (PRIOR ART)
FIG. 1E is a cross-sectional view of FIG. 1D taken at 1E-1E.
Figure 2:
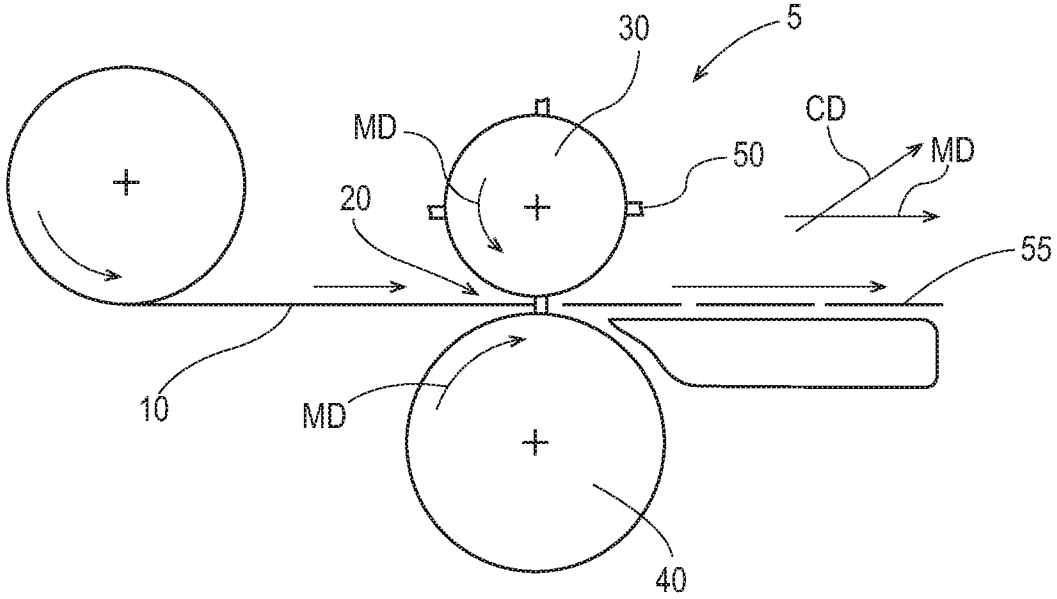
FIG. 2 is a plan view of an exemplary apparatus for cutting a web, including a rotary press and rotary anvil.

A rotary apparatus 5 for cutting a web 10 is shown in FIG. 2. The web 10 is fed in the machine direction MD towards the nip 20 between a rotary press 30 and a rotary anvil 40. One or more knives 50 are mounted on the rotary press 30. As the web 10 passes through the nip 20, a knife 50 cuts the web 10. This transforms the web 10 from its condition upstream of the apparatus 5 into separate pieces or articles 55 downstream of the apparatus 5. The knife 50 or knives 50 can be mounted on the rotary press 30, such that the knife 50 is perpendicular to, substantially perpendicular to, or about perpendicular to the surface of the press 30 or rotary press 30. Mounting the knife 50 perpendicular to, approximately perpendicular to, or within 10 degrees of perpendicular to the surface of a rotary press 30 can enable cutting shaped articles at a greater web 10 speed since a knife mounted at an angle less than about 90 degrees to the rotary press 30 may interfere with the article 55 as the article 55 passes through the nip 20. The change from mounting the knife 50 to be non-perpendicular to the rotary press 30 changes the manner in which the knife 50 accommodates deformation from being one of flexure to one in which deformation may be provided by compression and or deformation of the knife 50 in the cross direction.

In a rotary configuration, the rotary press 30 and rotary anvil 40 can be considered to have a machine direction MD as indicated in FIG. 2. The rotary press 30 and rotary anvil 40 rotate counter to one another to provide for a direction of movement though the nip 20 in the machine direction MD.

One of skill in the art will understand that the rotary press 30 and rotary anvil 40 of the present disclosure can be provided in a system that has a floating bearer ring on the rotary press 30 (i.e., cutting roll) and a fixed bearer ring on the rotary anvil 40 roll. It would be understood that a floating bearer ring is driven by the fixed bearer ring on the rotary anvil 40 independent of the rotational speed of the rotary press 30. Therefore, the rotary press 30 may be rotated faster or slower than the rotation of the floating bearer ring. This allows for rotation of the rotary press 30 to be sped up or slowed down depending on the pitch of the article to be cut. This makes the rotary anvil 40 essentially "pitchless" since the speed of the rotary anvil 40 determines where cuts will be made. This further provides for high precision on center-to-center distances and high roll parallelism owing to the bearing rings. These two features significantly improve discrete article separation.

Figure 3:
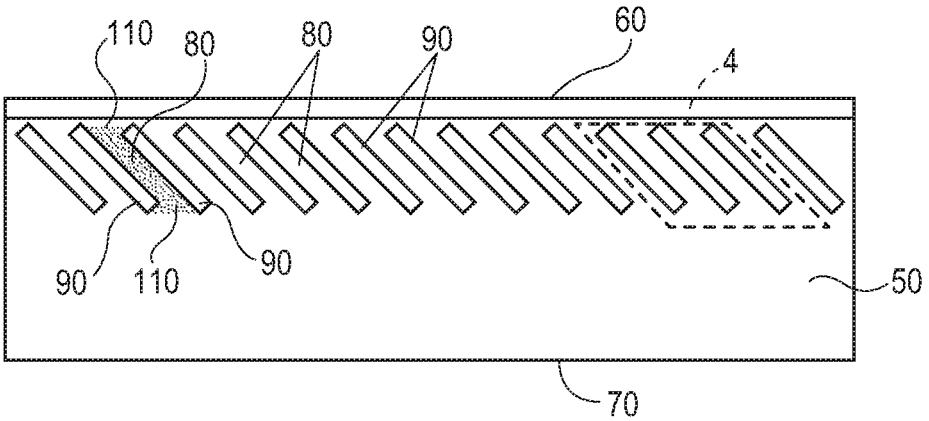
FIG. 3 is a side view of a knife.

As would be recognized by one of skill in the art of pitchless cutting, the tangential velocity of the rotary press 30 may bear any preferred relationship to the linear velocity of the product web that is being cut. By way of non-limiting example, the tangential velocity of the rotary press 30 may match the linear velocity of the product web. Alternatively, the tangential velocity of the rotary press 30 may differ from the velocity of the product web and be greater, or less, than the velocity of the product web at the point of cutting. A side view of a knife 50 is shown in FIG. 3. The knife 50 can have a cutting edge 60. The cutting edge 60 can be a sharpened portion of the knife 50. The knife 50 can be formed of a contiguous piece of thin metal or ceramic material. This material can be referred to as the knife blank. Optionally, the knife 50 can be formed by additive manufacturing in which the knife 50 is built up in multiple layers.

One edge of the knife blank can be sharpened to form the cutting edge 60. The cutting edge 60 can be shaped in any of the grinds common in the art of knife making. Such cuts can include, but not be limited to, a cut selected from the group consisting of hollow ground, flat ground, saber ground, chisel ground, compound bevel, convex ground, and combinations thereof.

The fixed edge 70 of the knife 50 can oppose the cutting edge 60 of the knife 50. The fixed edge 70 can be the edge of the knife 50 that is attached to the press 30. The knife 50 can be connected to the press 30 by through-hole bolts with bolt holes provided in the knife 50. The knife 50 can connected to the press 30 by a pinch grip or wedge grip. The gripping force in such grips can be applied by a screw mechanism or spring mechanism.

The knife 50 can be thought of as comprising a cutting edge 60, a fixed edge 70, and a plurality of beam elements 80 connecting the cutting edge 60 and the fixed edge 70. The beam elements 80 act to transfer force between the fixed edge 70 and the cutting edge 60. Each beam element 80 is separated from adjacent beam elements 80 by a reduced stiffness zone 90. The beam elements 80 are defined by the material between the reduced stiffness zones 90. One of the beam elements 80 is denoted by stippling in FIG. 3.

Figure 4:
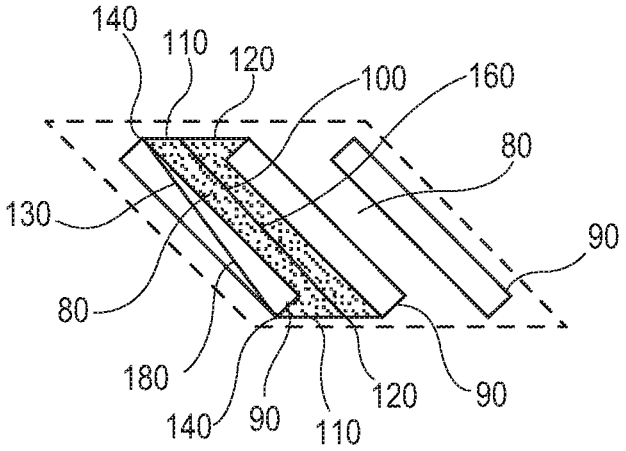
FIG. 4 is a partial view of the knife as marked in FIG. 3.

The beam elements 80 have a beam element extent 100. The beam element extent 100 is determined by connecting the reduced stiffness zones 90 adjacent a beam end 110 of the beam element 80 by a tangent line and bisecting that tangent line 120 (FIG. 4). FIG. 4 is a partial view as marked in FIG. 3. The same is done at the opposing beam end 110 of the beam element 80. The two bisection points of the tangent lines 120 define a line that is the beam element extent 100. The two tangent lines 120 define the beam ends 110.

The beam element extent 100 has a length, the length being a scalar quantity, for example 30 mm. A beam element 80 is bounded by the two reduced stiffness zones 90 between which the beam element resides and the two tangent lines 120 tangent to the reduced stiffness zones 90 at each beam end 110 of the beam element 80.

The beam element extent 100 can be oriented from about 20 degrees to about 80 degrees off of the cutting edge 60. The beam element extent 100 can be oriented from about 30 degrees to about 60 degrees of the cutting edge 60. Orienting the beam element extents 100 nearer to 45 degrees off of the cutting edge 60 can reduce the stress concentrations at the beam ends 110 proximal a reduced stiffness zone 90. The most desirable orientation of the beam element extent 100 can be a function of the shape of the beam elements 80.

The reduced stiffness zones 90 have a reduced stiffness zone extent 130. The reduced stiffness zone extent 130 is the line between the intersection of the tangent line 120 at one beam end 110 with one reduced stiffness zone end 140 and the intersection of the other tangent line 120 at the other beam end 110 with the same reduced stiffness zone end 140. The reduced stiffness zone extent 130 extends across the reduced stiffness zone 90 from one reduced stiffness zone end 140 to the other reduced stiffness zone end 140.

Each reduced stiffness zone extent 130 can be oriented from about 20 degrees to about 80 degrees off of the cutting edge 60.

The reduced stiffness zones 90 can be provided by various structures. The reduced stiffness zones 90 can be portions of the knife 50 that are thinner in the machine direction MD than the beam elements 80. That is, constituent material of the knife 50 can be removed in the reduced stiffness zones 90 so that the reduced stiffness zones 90 are thinner than the beam elements 110. As would be recognized by one of skill in the art, reduced stiffness zones 90 can be provided in a knife 50 starting from a knife blank by grinding material away, laser ablating, or otherwise removing material from the knife blank to form the reduced stiffness zone 90. Similarly, the knife 50 can be built up by additive manufacturing and the reduced stiffness zones 90 can be provided by not depositing constituent material in the reduced stiffness zones 90.

The reduced stiffness zones 90 provide the knife 50 with increased flexure without exceeding the strength of the constituent material of the knife 50. The knife 50 can be provided with the desired flexure by not exceeding the yield strength of the constituent material of the knife 50, thereby providing improved fatigue resistance as compared to a conventional knife 50. Optionally, the knife 50 can be designed such that ultimate strength of the constituent material of the knife 50 is not exceeded.

The knife 50 can comprise a composite material. For instance, the cutting edge 60, beam elements 80, and reduced stiffness zones 90 can be comprised of different materials. The cutting edge 60 and beam elements 80 can be formed of one material and the reduced stiffness zones 90 can be formed of a second material. Such a knife can be formed by additive manufacturing. Optionally, such a knife 50 can be formed by cutting out the reduced stiffness zones 90 from a knife blank to leave voids in the knife 50, the voids, by way of non-limiting example slots, being reduced stiffness zones 90 of the knife, or by removing material from the knife blank to form thinned portions of the knife 50 that are the reduced stiffness zones 90, as discussed previously.

Figure 5:
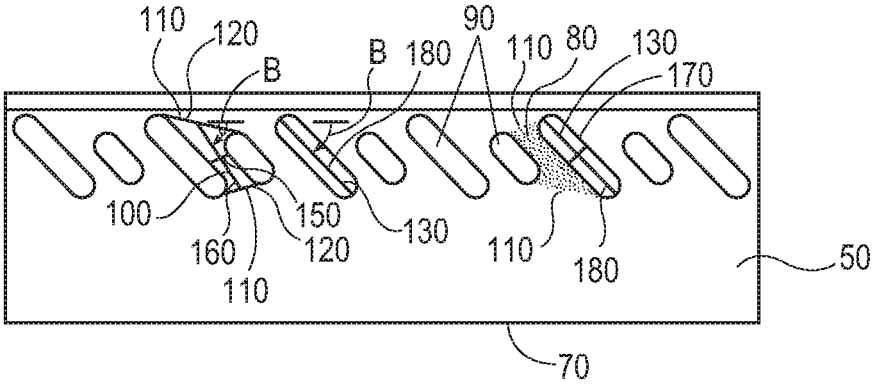
FIG. 5 is a side view of a knife.

The beam elements 80 can have shapes that differ from one another. A non-limiting example of such a knife is shown in FIG. 5. The beam element extent 100, beam ends 110, tangent lines 120, reduced stiffness zone extent 130, and reduced stiffness zone ends 140 are marked in FIG. 5. For a knife having beam elements 80 that differ in shape from one another, the reduced stiffness zones 90 can have different shapes from one another as well. Any one of, multiples of, or all of the beam elements 80, and thereby reduced stiffness zones 90, can differ in shape from one another. Each beam element 80, and thereby reduced stiffness zone 90, can have a unique shape. A knife 50 may have two different beam element 80 shapes, as shown in FIG. 5. Providing different shapes of the reduced stiffness zones 90 can be useful for customizing the stress distribution within the knife 50 and the development of cutting force of the knife 50 against the anvil 40. For instance, the thoroughness of the cutting might be made variable across the knife 50 with some portions of the knife 50 delivering a through cut of the web 10 and other portions of the knife 50 delivering a partial cut in the web 10.

As shown in FIGS. 3-5, the beam elements 80 can be oriented between about 20 degrees and about 80 degrees off of the cutting edge. In FIG. 5, the angle of the beam elements 80 off of the cutting edge 60 is marked as β.

The reduced stiffness zones 90 do not necessarily each have the same orientation relative to the cutting edge 60. For instance one or more reduced stiffness zones 90 can be oriented at about 30 degrees off of the cutting edge 60 and one or more of the other reduced stiffness zones 90 can be oriented at about 40 degrees off of the cutting edge 60. Providing for reduced stiffness zones 90 at differing orientations can be beneficial for controlling the pathways through which stress is conducted through the knife 50, where stress concentrations occur, and the magnitude thereof. Further, the knife 50 having reduced stiffness zones 90 is more flexible in the Z-direction than a similarly shaped knife 50 devoid of reduced stiffness zones 90. As the knife 50 deforms when cutting, the cutting edge 60 can move in the longitudinal direction L provide a small slicing movement to the cutting edge 60 relative to the web 10 being cut.

In conjunction with the reduced stiffness zones 90 being oriented at an angle off of the cutting edge, the beam elements 80 can be oriented as such as well. The beam elements 80 have a beam element width 150, as shown in FIG. 5. The beam element width 150 is orthogonal to the beam element extent 100 and is the maximum value of such measure orthogonal to the beam element extent 100. Likewise, the beam elements 80 have a beam element length 160, which is a scalar quantity, in line with the beam element extent 100. The beam element 80 can have a ratio of beam element length 160 to beam element width from about 2 to about 40. Like the reduced stiffness zones 90, the beam elements 80 need not have the same orientation relative to the cutting edge 60. Differing orientations of the beam elements 80 can help to control the pathways through which stresses are conducted through the knife 50, where stress concentrations occur, and the magnitude thereof. The stress in the knife 50 can be maintained at a level less than the yield strength of the constituent material of the knife 50.

The reduced stiffness zones 90 can have a reduced stiffness zone width 170, as shown in FIG. 5. The reduced stiffness zone width 170 is orthogonal to the reduced stiffness zone extent 130 and is the maximum value of such measure orthogonal to the reduced stiffness zone extent 130. The reduced stiffness zone width 170 is orthogonal to the reduced stiffness zone extent 130. Likewise, the reduced stiffness zones 90 have a reduced stiffness zone length 180, which is a scalar quantity, in line with the reduced stiffness zone extent 130. The reduced stiffness zone 90 can have a ratio of reduced stiffness zone length 180 to reduced stiffness zone width 170 from about 2 to about 40. In general, the higher the ratio of reduced stiffness zone length 180 to reduced stiffness zone width 170, other design factors being equal, the more flexible the knife 50.

The beam elements 80 can be nearer to the cutting edge 60 than to the fixed edge 70. Such an arrangement can be desirable for allowing small deformations of the cutting edge 60 to conform to the anvil 40, which might have an irregular surface, or to accommodate variability in the properties of the web 10 that have an effect on cutting.

Figure 6:
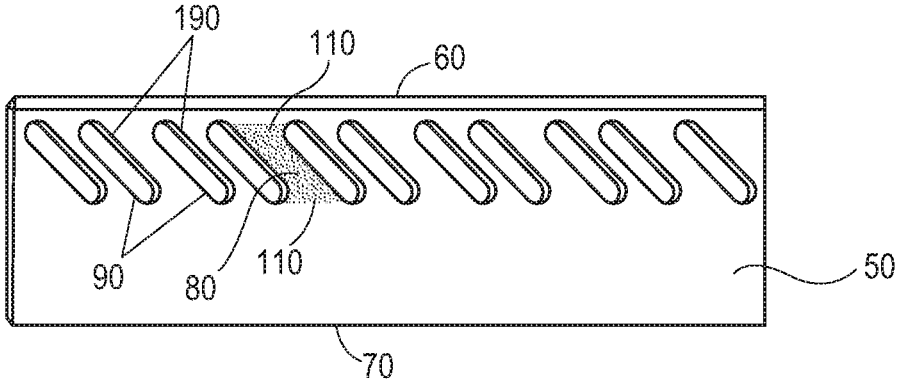
FIG. 6 is a side view of a knife having slots.

As shown in FIG. 6, the reduced stiffness zones 90 can be slots 190. Slots 190 are discontinuities in the constituent material forming the knife 50. By there being an absence of constituent material of the knife 50 at the slots 190, the slots 190 are a completely reduced stiffness zone 90. That is, since there is no constituent material of the knife 50 at the slot 190, there is no resistance to deformation of the knife 50 provided by the slot 190. Stress from the applied cutting force at the cutting edge 60 is transmitted around the slot 190 through the constituent material of the knife 50 forming the beam elements 80 towards the fixed edge where that stress is conducted to the press 30.

Slots 190 can be provided by machining out constituent material from the knife 50 to leave a void in the knife 50. Optionally, additive manufacturing can be used to build up the knife 50 and not depositing material at a position in which a slot 190 is desired.

Figure 7:
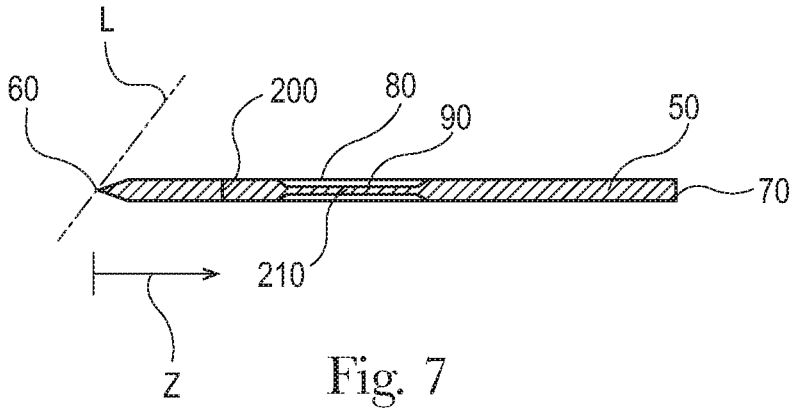
FIG. 7 is a cross section of a knife having a reduced stiffness zone that is a thinned portion of the knife.

In some instances, it may be advantageous to not provide reduced stiffness zones 90 as slots 190. Rather, it can be advantageous that the reduced stiffness zones 90 are portions of the knife 50 that are thinner than portions of the knife 50 adjacent the reduced stiffness zones 90. As shown in FIG. 7, the cutting edge 60 can define a longitudinal axis L. The knife 50 can be considered to have a z-axis between the cutting edge 60 and the fixed edge 70 orthogonal to the longitudinal axis L. The beam elements 80 can have a beam element thickness 200 in a direction orthogonal to a plane defined by the longitudinal axis L and the z-axis. The reduced stiffness zones 90 can have a reduced stiffness zone thickness 210, taken as the average thickness of the reduced stiffness zone 90, in a direction orthogonal to a plane defined by the longitudinal axis L and the z-axis. The beam element thickness 200 can be greater than the reduced stiffness zone thickness 210. By providing for reduced stiffness zones 90 that are thinned portions of the knife 50, deformation of the knife 50 from loads applied to the cutting edge 60 can be tuned as desirable.

Contemplated herein is a knife 50 in which the reduced stiffness zones 90 are made of a material that is different from the material that comprises the beam elements 80. The beam elements 80 can have a beam element modulus of elasticity and the reduced stiffness zones 90 can have a reduced stiffness zone modulus of elasticity. The beam element modulus of elasticity can be greater than the reduced stiffness zone modulus of elasticity. If desirable, this can be accomplished by forming slots 190 in the knife 50 and filling in the slots 190 with a material having lower modulus of elasticity than the beam elements 80, with the lower modulus of elasticity material forming the reduced stiffness zone 90, or optionally be accomplished by selective additive manufacturing. The modulus of elasticity of the beam elements 80 can be from about 70 GPa to about 1200 GPa. The modulus of elasticity of the reduced stiffness zones 90 can be from about 0.001 GPa to about 1200 GPa.

The reduced stiffness zones 90 can be slots 190, portions of the knife 50 that having an average thickness less than the thickness of the adjacent beam elements 80, or portions of the knife 50 having a lower modulus of elasticity than the material comprising the adjacent beam elements 80.

The knife 50 can be practical to employ in an apparatus 5 for cutting a web 10 of material. The apparatus 5 can comprise a rotary press 30 having a machine direction MD and cross direction CD orthogonal to the machine direction, as shown in FIG. 2. The rotary press 30 can be a drum or other structure to which one or more knives 50 can be attached. The rotary press 30 can be driven by a motor. The rotary press 30 can be a single speed device, a variable speed device, intermittent speed device, or cyclically variable speed device.

The apparatus can further comprise a rotary anvil 40. The rotary anvil 40 can be a solid or a hollow cylinder of steel, hardened steel or other rigid material against which a web can be cut by knife 50.

The knife 50 can comprise any of the knives 50 disclosed herein. The cutting edge 60 can be a straight line or a plurality of spaced apart straight lines, by way of non-limiting example.

As shown in FIG. 2, knife 50 can be mounted to the rotary press 30 with the cutting edge 60 can be oriented in the cross direction CD of the rotary press 30. The knife 50 can be attached to the rotary press 30 by through bolts, wedges, grips, and the like.

The knife 50 can be used in a process of cutting a web. A web 10 can be provided. The process can comprise a step of providing a knife 50 mounted on a press 30. The knife 50 can be a knife 50 as disclosed herein. The press 30 can be a rotary press 30. An anvil 40 can be provided to support the web 10 as the web 10 passes between the anvil 40 and the press 30. The anvil 40 can be rotating counter to the press 30. The web 10 can be cut with the knife 50 as the web 10 passes between the press 30 and anvil 40.

The cutting edge 60 can be a linear cutting edge 60. A linear cutting edge 60 can be employed to make straight cuts. The cutting edge can be intermittent linear sections. The shape of the cutting edge 60 can be selected so as to provide the desired contour of the cut, intermittent cut, or cut of variable depth and contour in the MD-CD plane of the web 10. An intermittent cutting edge 60 can be practical for providing perforations in a web 10. Similarly, an intermittent cutting edge 60 can be practical for providing for a frangible boundary in the web 10. The cutting edge 60 can be shaped in the z-axis to provide for a variable depth of cut in the web 10 or even a variable depth of an incision in the web 10. Intermittently spaced cuts, variable depths of incision, through cuts, and shaped cuts or incisions in combination with continuous cuts and intermittent cuts can be provided to provide the desired cut, perforation, frangible boundary, and the like. These various alterations of the web 10 can be provided by selecting the shape of the cutting edge 60 and the relationship between the cutting edge 60 and the anvil 40.

Figure 8:
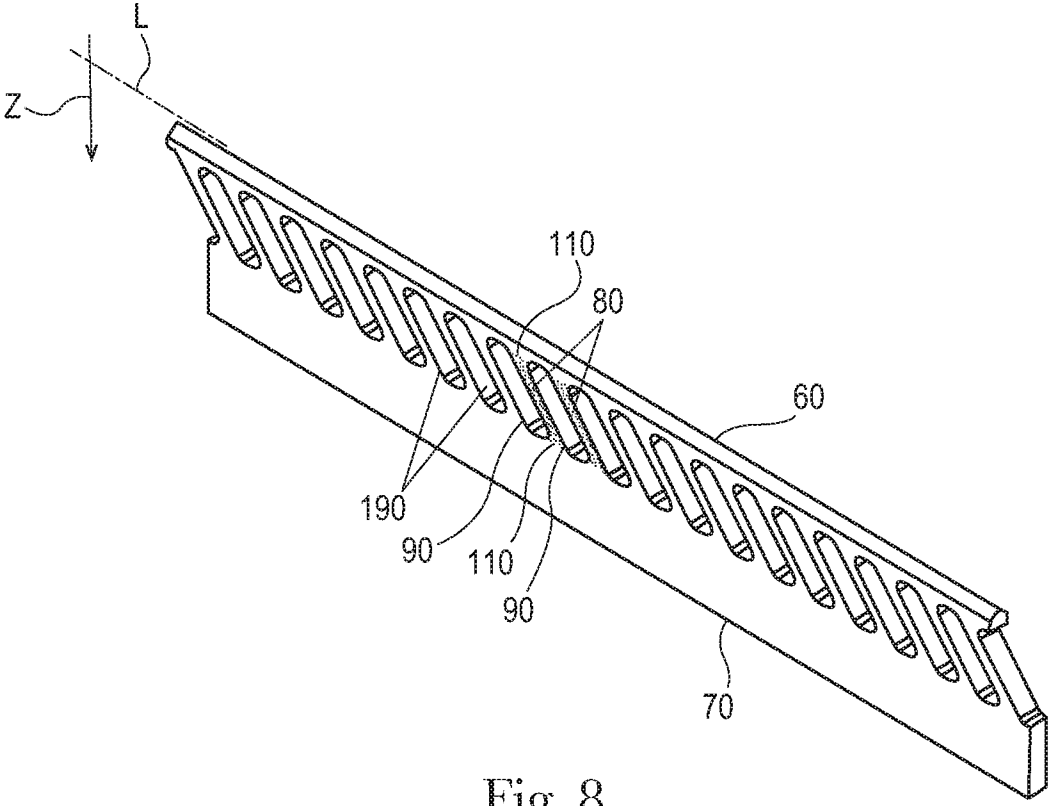
FIG. 8 is a perspective view of a knife.

An example of a knife 50 is shown in FIG. 8. The knife 50 can be comprised of steel. The knife 50 can have beam element width 150 of about 2.8 mm or even about 3.2 mm. The knife 50 can have a beam element length 160 of about 19 mm or even about 28 mm. The knife 50 can have a reduced stiffness zone width 170 of about 4.9 mm or even about 7.1 mm. The knife 50 can have a reduced stiffness zone length 180 of about 19 mm or even about 28 mm. The knife 50 can have a distance between the cutting edge 60 and fixed edge 70 of about 33.5 mm. The knife 50 can have a cutting edge 60 having a length as may be required in order to effectuate the cut or perforation desired. The knife 50 can have a thickness of about 3 mm or even about 5 mm or even about 7 mm.

Figure 9:
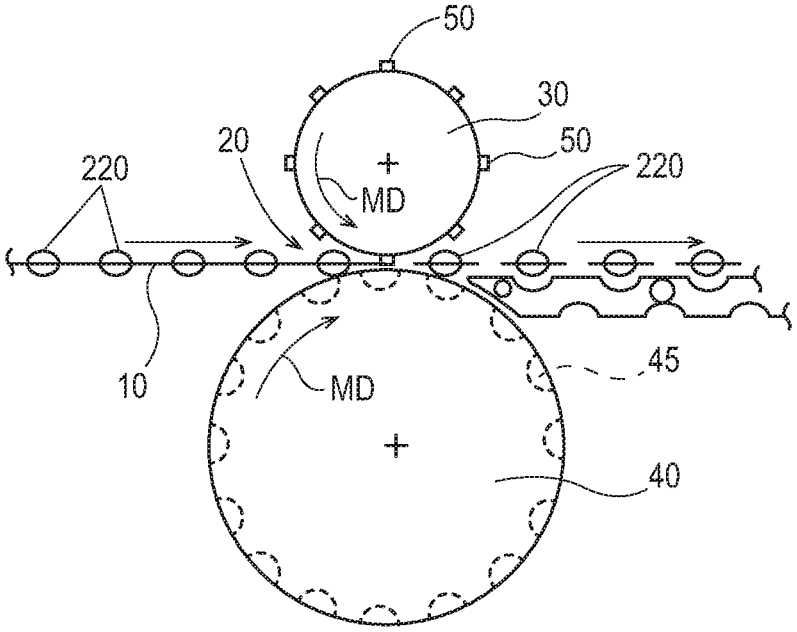
FIG. 9 is an apparatus for cutting a web of pouches.

The knife 50 can be used in a process for cutting water soluble unit dose pouches 220, by way of non-limiting example as shown in FIG. 9. A web 10 of pouches 220 connected to one another in the machine direction MD can be fed into the nip 20 between the press 30 and anvil 40 and cut. The press 30 can be a rotary press 30 provided with a plurality of knives 50 spaced apart from one another in the machine direction MD at a spacing corresponding to the pitch between individual pouches 220 so that individual pouches 220 cut from one another. The anvil 40 can be provided with pockets 45 to accommodate the pouches 220.

In the exemplary embodiment shown in FIGS. 10-13, a flexible curvilinear knife 500 is formed from essentially three elements. Flexible curvilinear knife 500 can be formed from a cutting element 510 and a blade holder element 530. Cutting element 510 is operatively connected to blade holder element 530 by a plurality of spring elements 520. A proximal end 550 of each spring element 525 of the plurality of spring elements 520 can be operably and fixably attached to a discrete location of cutting element 510 and a distal end 560 of each spring element 525 of the plurality of spring elements 520 can be operably and fixably attached to a discrete location of blade holder element 530. Naturally, one of skill in the art will appreciate that cutting element 510 is provided with a knife edge 540 in order to facilitate the cutting of a web material when the knife edge 540 of flexible curvilinear knife 500 is in contacting and mating engagement with an anvil opposed thereto. One of skill in the art will appreciate that knife edge 540 can be provided as a single, elongate blade suitable for providing continuous curvilinear cuts for elongate web materials suitable for the formation of assembled products such as diapers, catamenial devices and adult incontinence articles. Alternatively, one of skill in the art will appreciate that knife edge 540 can be provided as plurality of discrete blade segments suitable for perforating elongate web materials suitable for the formation of consumer products such as bath tissue and paper toweling.

Without desiring to be bound by theory, it is believed that each spring element 525 of the plurality of spring elements 520 can be a linear spring (i.e., obeys Hooke's law) or a non-linear spring, (i.e., does not obey Hooke's law). One of skill in the art will appreciate that a linear spring utilized for a spring element 525 of the plurality of spring elements 520 is understood to mean that as long as each spring element 525 of the plurality of spring elements 520 are not stretched or compressed beyond their elastic limit, each spring element 525 of the plurality of spring elements 520 will obey Hooke's law, which states that the force with which the spring element 525 pushes back is linearly proportional to the distance from its equilibrium length such that:

$$\sigma = E\epsilon$$

where:

$\sigma$=Stress;

E=Modulus of Elasticity; and, $\epsilon$=Axial Unitary Deformation.

The above equation can be re-written as:

$$F = -kx$$

where:

F=resulting force vector (i.e., the magnitude and direction of the restoring force the spring exerts);

k=spring constant (e.g., also the force constant, or stiffness, of the spring). This is a constant that depends on the spring's material, shape, and/or construction. The negative sign indicates the force exerted by the spring is in the direction opposite its displacement; and, x=displacement vector (i.e., the distance and direction the spring is deformed from its equilibrium length).

According to this formula, a graph of the applied force F as a function of the displacement x will be a straight line passing through the origin, whose slope is k. In other words, the spring constant is a characteristic of a spring which is defined as the ratio of the force affecting the spring to the displacement caused by it. By way of example, springs suitable for use as a spring element 525 can include coil springs and other common springs that obey Hooke's law.

Springs suitable for use as a spring element 525 can be based on simple beam bending that can produce forces that vary non-linearly with displacement. Further, if made with constant pitch (wire thickness), conical springs can have a variable rate. However, a conical spring suitable for use as a spring element 525 can be made to have a constant rate by creating the spring with a variable pitch. A larger pitch in the larger-diameter coils and a smaller pitch in the smaller-diameter coils will force the spring to collapse or extend all the coils at the same rate when deformed.

Since force is equal to mass, m, times acceleration, a, the force equation for a spring obeying Hooke's law provides:

$$F=ma \rightarrow -kx=ma$$

It is preferred that the mass of the spring element 525 be small in comparison to the mass of the mass of both cutting element 510 and blade holder element 530 and is ignored. Since acceleration is simply the second derivative of x with respect to time, $$-kx = m\frac{d^2x}{dt^2}$$

This is a second order linear differential equation for the displacement as a function of time. Re-arranging:

$$\frac{d^2x}{dt^2} + \frac{k}{m}x = 0$$

the solution of which is the sum of a sine and cosine:

$$x(t) = A\sin\left(t\sqrt{\frac{k}{m}}\right) + B\cos\left(t\sqrt{\frac{k}{m}}\right)$$

where:

A, B=arbitrary constants that may be found by considering the initial displacement and velocity of the mass.

As would be understood by one of skill in the art, a spring can be seen as a device that stores potential energy, specifically elastic potential energy, by straining the bonds between the atoms of an elastic material. Hooke's law of elasticity states that the extension of an elastic rod (e.g., its distended length minus its relaxed length) is linearly proportional to its tension, the force used to stretch it. Similarly, the contraction (i.e., negative extension) is proportional to the compression (i.e., negative tension).

Hooke's law is a mathematical consequence of the fact that the potential energy of the rod is a minimum when it has its relaxed length. Any smooth function of one variable approximates a quadratic function when examined near enough to its minimum point as can be seen by examining the Taylor series. Therefore, the force—which is the derivative of energy with respect to displacement—will approximate a linear function. The force of a fully compressed spring is provided as:

$$F_{max} = \frac{Ed^4(L-nd)}{16(1+v)(D-d)^3n}$$

where:

E=Young's modulus;

d=spring wire diameter;

L=free length of spring;

n=number of active windings;

v=Poisson ratio; and,

D=spring outer diameter.

One of skill in the art will appreciate that a non-linear spring utilized for a spring element 525 of the plurality of spring elements 520 is understood to mean that a non-linear relationship exists between the force applied to the spring and the spring's resulting displacement. One of skill in the art will appreciate that a graph showing force vs. displacement for a non-linear spring will be more complicated than a straight line, with a changing slope. Stated differently, a non-linear spring each spring element 525 of the plurality of spring elements 520 does not obey Hooke's law such that the applied force is related to the relative displacement such that:

$$F=kF(x)$$

where:

F=applied force;

x=spring displacement from the spring's neutral position; and, k=spring constant (i.e., stiffness).

The resulting spring constant is provided as:

$$k = \frac{dF}{dx}$$

Figure 11:
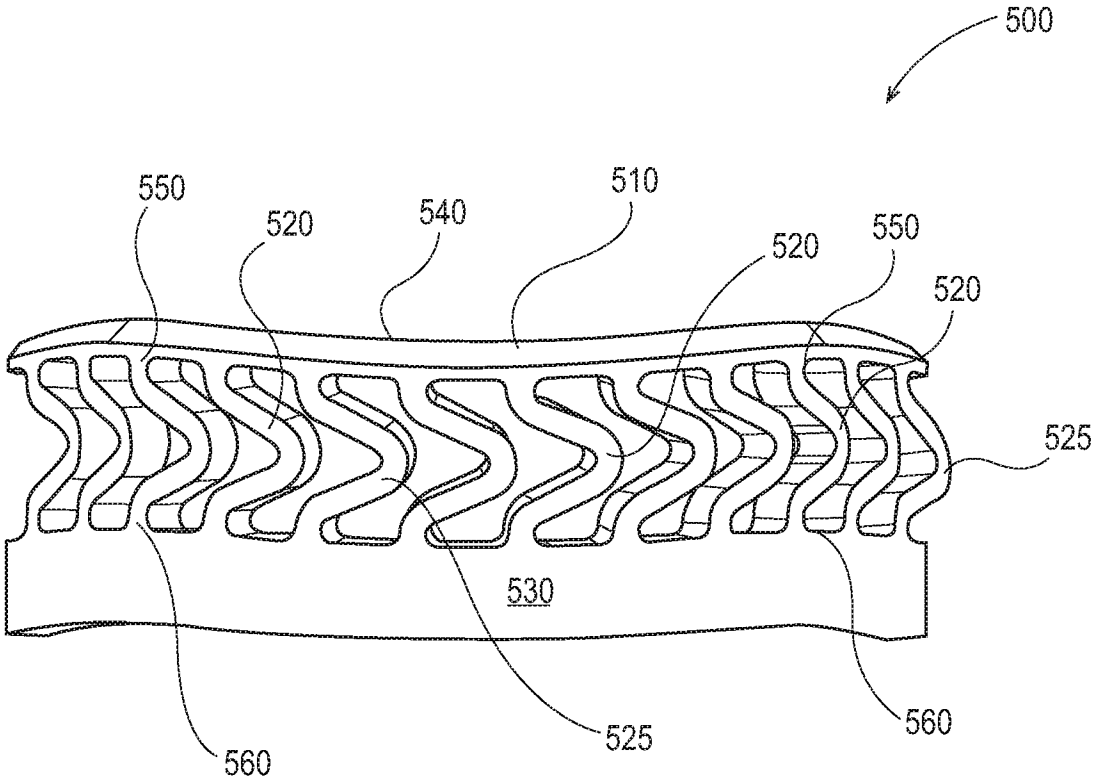
FIG. 11 is a planar view of the exemplary flexible curvilinear knife of FIG. 10.
Figure 11A:
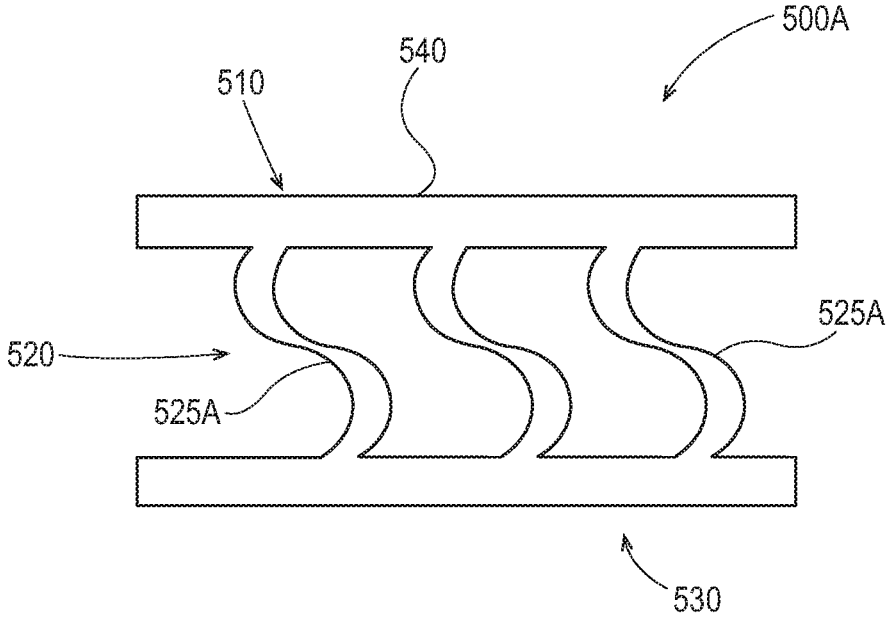
FIG. 11A is a planar view of an another exemplary spring element having a sinusoidal shape suitable for use with a flexible curvilinear knife.
Figure 12:
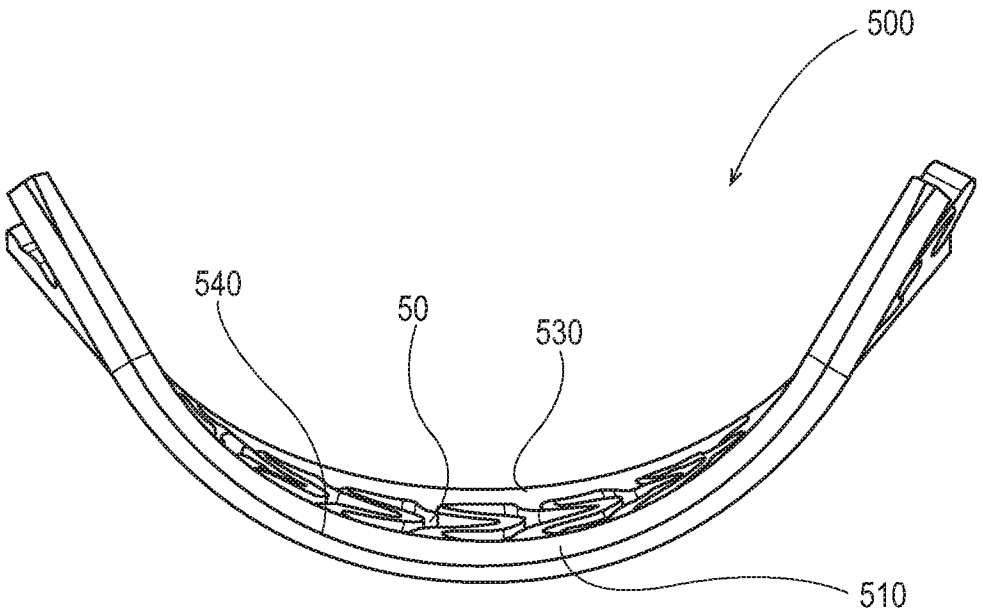
FIG. 12 is a top plan view of the exemplary flexible curvilinear knife of FIG. 10.
Figure 13:
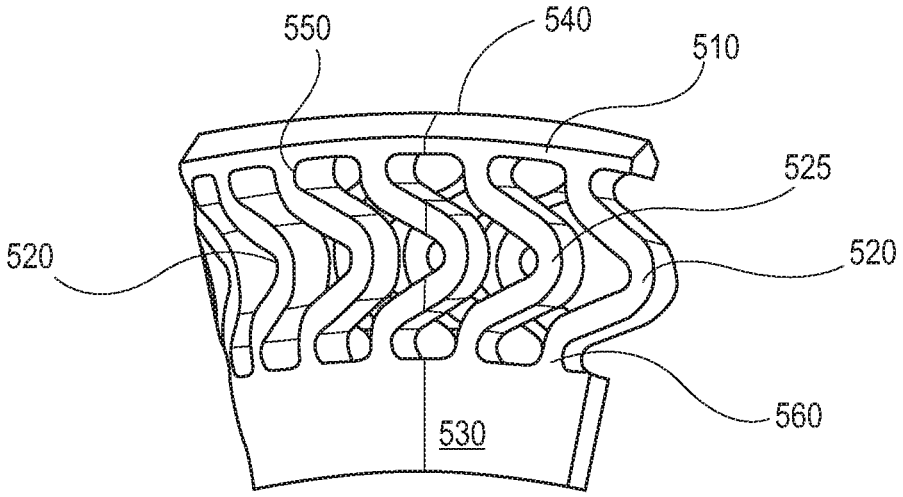
FIG. 13 is an alternative planar view of the exemplary flexible curvilinear knife of FIG. 10.

Therefore, it should be understood and appreciated by one of skill in the art that a spring element 525 suitable for use in the flexible curvilinear knife 500 can include all springs, no matter the design or shape, that obey, or do not obey, Hooke's law. For example, FIG. 11A provides an exemplary spring element 525A suitable for use in the flexible curvilinear knife 500 having a sinusoidal shape. Without desiring to be bound by theory, it is believed that the exemplary spring element 525A having a sinusoidal shape obeys Hooke's law. Further, it should be understood and appreciated by one of skill in the art that spring elements 525 comprising any combination of linear and non-linear springs can be suitable for use in the flexible curvilinear knife 500. In other words, any suitable combination of spring elements can include all springs, no matter the design, matter of construction, or shape that obey, or do not obey, Hooke's law can be suitable for use in the flexible curvilinear knife 500 in order to provide the desired degree of localized deformation for the cutting element 510 of flexible curvilinear knife 500.

It is believed that each spring element 525 of the plurality of spring elements 520 can be provided with the same spring constant, k. Alternatively, it is believed that each spring element 525 of the plurality of spring elements 520 can be provided with an individualized spring constant, k. In other words, a first spring element 525 of the plurality of spring elements 520 can be provided with a first spring constant, $k_1$, and a second spring element 525 of the plurality of spring elements 520 can be provided with a second spring constant, $k_2$. The first spring constant, $k_1$, can be different from the second spring constant, $k_2$ (e.g., the first spring constant, $k_1$, can be less than the second spring constant, $k_2$, or the first spring constant, $k_1$, can be greater than the second spring constant, $k_2$). By way of benefit of the present flexible curvilinear knife 500, providing each spring element 525 of the plurality of spring elements 520 can provide flexible the cutting element 510 of flexible curvilinear knife 500 with the ability to have a localized, discrete, flexural modulus thereby increasing the operable lifetime of the flexible curvilinear knife 500 and reducing potential catastrophic degradation of the flexible curvilinear knife 500.

In mechanics, the flexural modulus or bending modulus, E, is an intensive property that is computed as the ratio of stress to strain in flexural deformation, or the tendency for a material to bend. It is determined from the slope of a stress-strain curve produced by a flexural test (such as ASTM D790), and has units of force per area.

For a 3-point test of a rectangular beam behaving as an isotropic linear material, where w and h are the width and height of the beam, I is the second moment of area of the beam's cross-section, L is the distance between the two outer supports, and d is the deflection due to the load F applied at the middle of the beam, the flexural modulus, E, is provided by:

$$E_{bend} = \frac{L^3 F}{4wh^3 d}$$

From elastic beam theory, the deflection, d, is provided as:

$$d = \frac{L^3 F}{48IE}$$

For a rectangular beam, the moment, I, is provided by:

$$I = \frac{1}{12} wh^3$$

Thus:

$E_{bend}$=E (i.e., Elastic modulus)

One of skill in the art will recognize that ideally, flexural or bending modulus of elasticity is equivalent to the tensile or compressive modulus of elasticity. In reality, these values may be different, especially for plastic materials.

Figure 14:
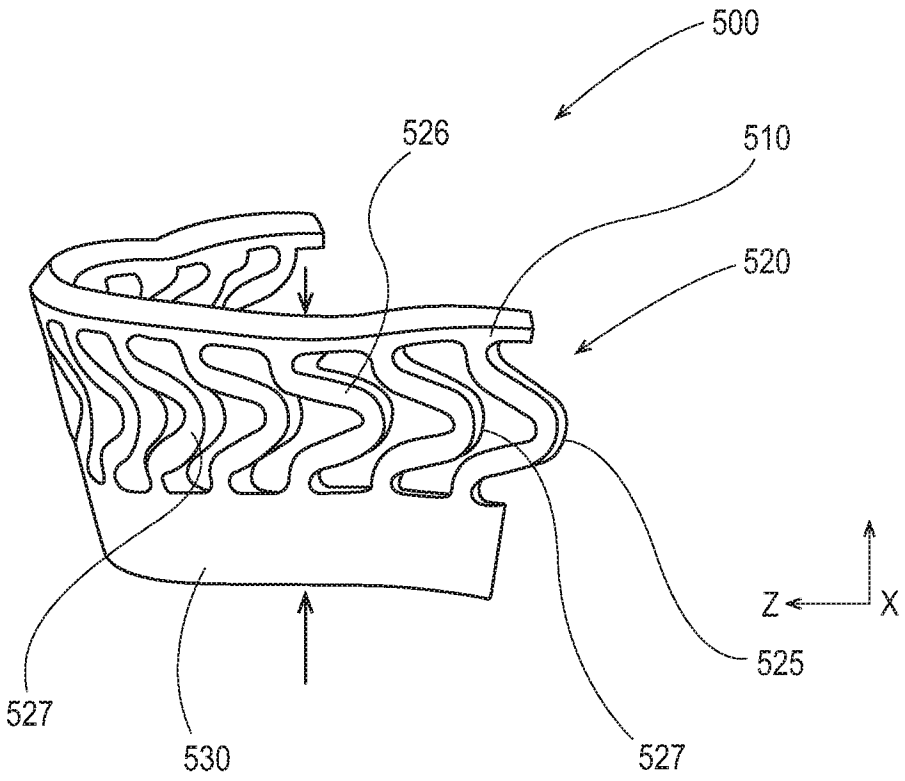
FIG. 14 is a perspective view of the exemplary flexible curvilinear knife of FIG. 10 as would appear when the flexible curvilinear knife of FIG. 10 engages an anvil when a web material is disposed therebetween showing a localized deformation within the cutting element relative to the blade holder element and where the deformation within the cutting element causes a contraction within at least one spring element proximate to the localized deformation and operatively connected to and disposed between the cutting element and blade holder.

Thus, using the above theory, one of skill in the art will appreciate that each spring element 525 of the plurality of spring elements 520 can provide a discrete, and distinct flexural modulus for each portion of the cutting element 510 of flexible curvilinear knife 500. For example, as shown in FIG. 14, as a first portion of the exemplary flexible curvilinear knife 500 of FIG. 10 engages an anvil when a web material is disposed therebetween a localized deformation within the cutting element 510 relative to the blade holder 530 occurs. It is believed that this localized deformation within the cutting element 510 causes a contraction within at least one spring element proximate to the localized deformation 526 and operatively connected to and disposed between the cutting element 510 and blade holder 530. When the first localized deformation within the cutting element 510 occurs, regions of the cutting element disposed adjacent the localized deformation are not so deformed. It is believed that the spring elements 527 located adjacent the at least one spring element proximate to the localized deformation 526 of cutting element 510 are not compressed, or alternatively, are compressed to a lesser degree than the at least one spring element proximate to the localized deformation 526 of cutting element 510 according to the spring constant, k, associated with each respective spring element 525 of the plurality of spring elements 520. To facilitate a differential deformation within the cutting element 510, it may be advantageous for a first portion of the cutting element 510 from a first material and a second portion of the cutting element 510 from a second material. The first and second materials forming the cutting element 510 can be different. Alternatively, it may be advantageous for each portion of the cutting element 510 to be formed from the same material.

Figure 10:
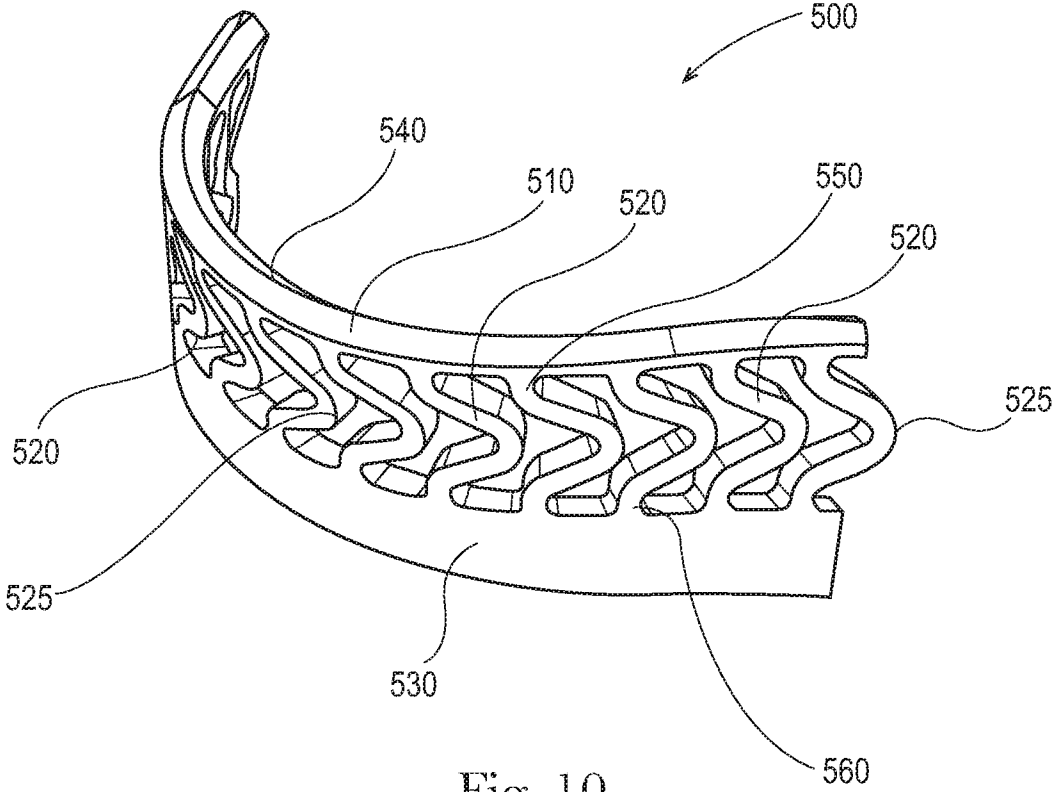
FIG. 10 is a perspective view of an exemplary flexible curvilinear knife of the present disclosure.
Figure 15:
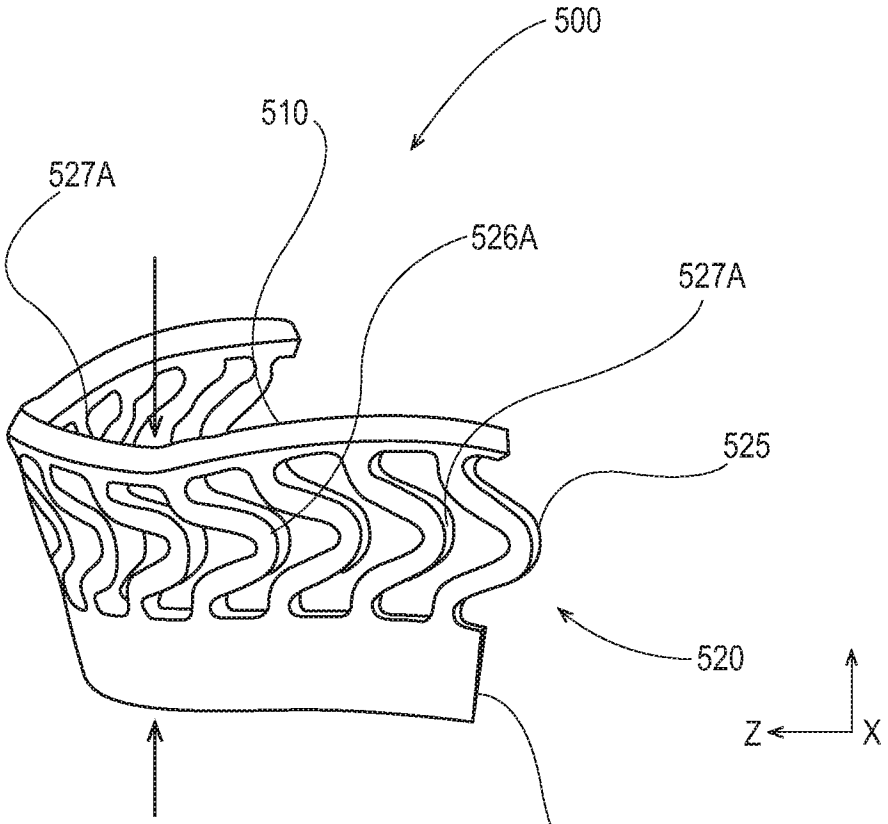
FIG. 15 is a perspective view of the exemplary flexible curvilinear knife of FIG. 10 as would appear when the flexible curvilinear knife of FIG. 10 engages an anvil when a web material is disposed therebetween showing another localized deformation within the cutting element relative to the blade holder element and where the deformation within the cutting element causes a contraction within at least another one spring element proximate to the new localized deformation and operatively connected to and disposed between the cutting element and blade holder.

As shown in FIG. 15, as the first portion of the flexible curvilinear knife 500 of FIG. 10 engaged with an anvil disengages and a second portion of the exemplary flexible curvilinear knife 500 of FIG. 10 engages the anvil (whether or not having a web material disposed therebetween), a second localized deformation within the cutting element 510 relative to the blade holder 530 can occur.

As discussed supra, it is believed that this second localized deformation within the cutting element 510 causes a contraction within at least one spring element proximate to the localized deformation 526A and operatively connected to and disposed between the cutting element 510 and blade holder 530. When the second localized deformation within the cutting element 510 occurs, regions of cutting element 510 disposed adjacent the second localized deformation are not so deformed. It is believed that the spring elements 527A located adjacent the at least one spring element proximate to the localized deformation 526A of cutting element 510 are not compressed, or alternatively, are compressed to a lesser degree than the at least one spring element proximate to the localized deformation 526A of cutting element 510 according to the spring constant, k, associated with each respective spring element 525 of the plurality of spring elements 520.

Figure 16:
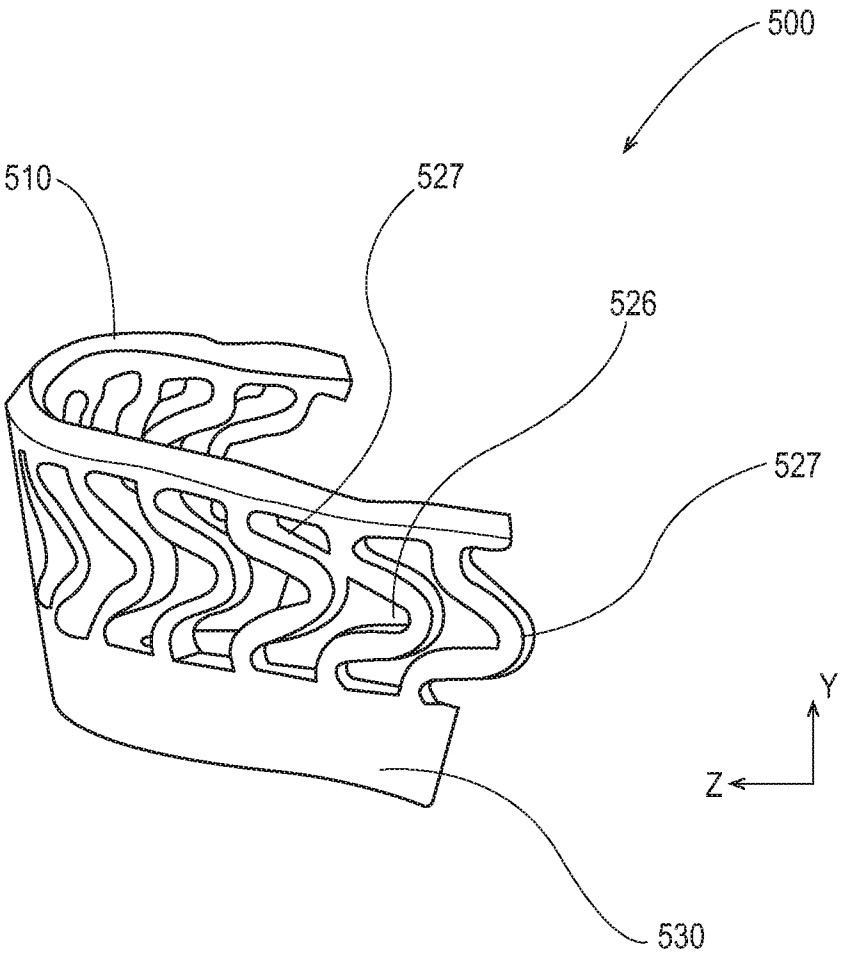
FIG. 16 is a perspective view of the exemplary stress graphic of the locally deformed flexible curvilinear knife of FIG. 14.
Figure 17:
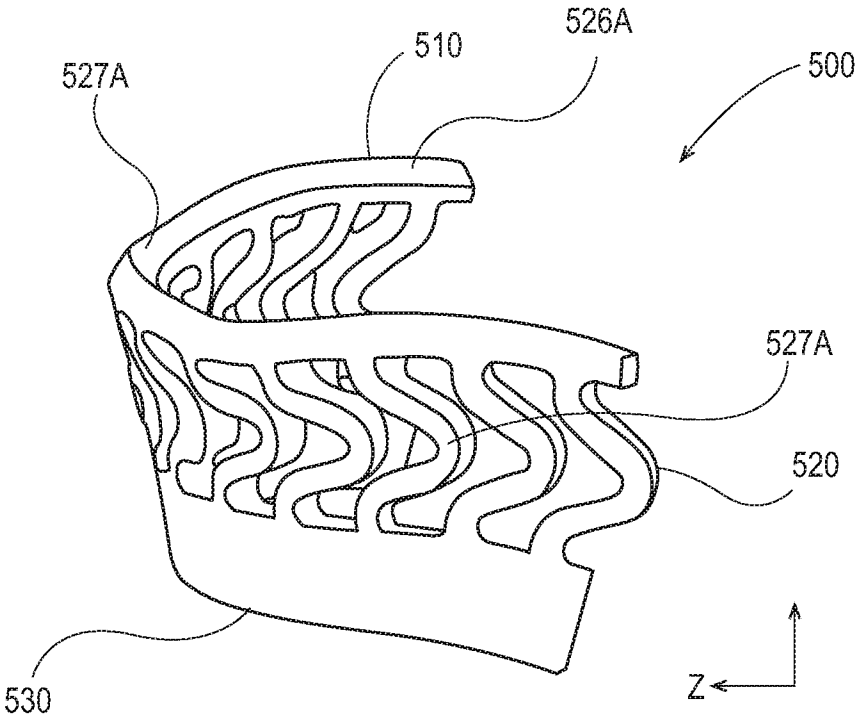
FIG. 17 is a perspective view of the exemplary stress graphic of the locally deformed flexible curvilinear knife of FIG. 15.

This localized deformation in the cutting element 510 and the associated compression of the respective spring elements 527, 527A operatively connected thereto and located adjacent the at least one spring element proximate to the localized deformation 526, 526A can be observed in exemplary the stress diagrams provided in FIGS. 16-17. As represented, when the cutting element 510 of the flexible curvilinear knife 500 is contactingly engaged with an opposed anvil, the opposed anvil can cause a first portion of the cutting element 510 to displace relative to the blade holder 530 and a second portion of the cutting element 510 does not displace relative to the blade holder 530. Alternatively, the cutting element 510 of the flexible curvilinear knife 500 can displace relative to the blade holder 530 causes the first, proximal end of a first spring element 525 of the plurality of spring elements 520 to displace relative to the blade holder 530. In still a further configuration, the cutting element 510 of the flexible curvilinear knife can displace relative to the blade holder 530 causing the first, proximal end of a first spring element 525 of the plurality of spring elements 520 to displace relative to a second, distal end of the first spring element 525 of the plurality of spring elements 520.

When each spring element 525 of the plurality of spring elements 520 provides a discrete, and distinct, flexural modulus for each portion of flexible curvilinear knife 500, as a first portion of the exemplary flexible curvilinear knife 500 of FIG. 10 engages an anvil when a web material is disposed therebetween a localized deformation within the cutting element 510 relative to the blade holder 530 occurs. As can be seen in FIG. 16, localized deformation within the cutting element 510 causes a contraction within at least one spring element proximate to the localized deformation 526. Regions of the cutting element 510 disposed adjacent the localized deformation are not so deformed. The spring elements 527 located adjacent the at least one spring element proximate to the localized deformation 526 are not compressed or are compressed to a lesser degree than the at least one spring element proximate to the localized deformation 526 according to the spring constant, k, associated with each respective spring element 525 of the plurality of spring elements 520.

As can be seen in FIG. 17, as the first portion of the flexible curvilinear knife 500 of FIG. 10 engaged with an anvil disengages and a second portion of the exemplary flexible curvilinear knife 500 of FIG. 10 engages the anvil when a web material is disposed therebetween a second localized deformation within the cutting element 510 relative to the blade holder 530 occurs. This second localized deformation within the cutting element 510 causes a contraction within at least one spring element proximate to the localized deformation 526A and operatively connected to and disposed between the cutting element 510 and blade holder 530. When the second localized deformation within the cutting element 510 occurs, regions of cutting element 510 disposed adjacent the second localized deformation are not so deformed. It is believed that the spring elements 527A located adjacent the at least one spring element proximate to the localized deformation 526A are not compressed, or alternatively, are compressed to a lesser degree than the at least one spring element proximate to the localized deformation 526A according to the spring constant, k, associated with each respective spring element 525 of the plurality of spring elements 520. Thus, it is believed to be surprisingly advantageous to provide each spring element 525 of the plurality of spring elements 520 to be provided with a spring constant, k, suitable and necessary for the cutting operation for which the flexible curvilinear knife 500 will be used.

Returning again to FIG. 10, it was surprisingly found that a flexible curvilinear knife 500 can be manufactured in the form of a uni-body construction. Such uni-body constructions typically enable building parts one layer at a time through the use of typical techniques such as SLA/stereo lithography, SLM/Selective Laser Melting, RFP/Rapid freeze prototyping, SLS/Selective Laser sintering, EFAB/Electrochemical fabrication, DMDS/Direct Metal Laser Sintering, LENS/Laser Engineered Net Shaping, DPS/Direct Photo Shaping, DLP/Digital light processing, EBM/Electron beam machining, FDM/Fused deposition manufacturing, MJM/Multiphase jet modeling, LOM/Laminated Object manufacturing, DMD/Direct metal deposition, SGC/Solid ground curing, JFP/Jetted photo polymer, EBF/Electron Beam Fabrication, LMJP/liquid metal jet printing, MSDM/Mold shape deposition manufacturing, SALD/Selective area laser deposition, SDM/Shape deposition manufacturing, combinations thereof, and the like. However, as would be recognized by one familiar in the art, such a uni-body flexible curvilinear knife 500 can be constructed using these technologies by combining them with other techniques known to those of skill in the art such as casting. As a non-limiting example, an "inverse knife" having the construction and/or elements associated thereto desired for a particular flexible curvilinear knife 500 could be fabricated, and then the desired flexible curvilinear knife 500 material could be cast around the fabrication. A non-limiting variation of this would be to make the fabrication out of a soluble material which could then be dissolved once the casting has hardened to create the flexible curvilinear knife 500.

Further, flexible curvilinear knife 500 can be manufactured from conventional machining techniques utilizing manually controlled hand wheels or levers, or mechanically automated by cams alone. Alternatively, flexible curvilinear knife 500 can be manufactured from machining techniques utilizing Computer Numeric Control (CNC) automated machine tools operated by precisely programmed commands encoded on a storage medium (computer command module, usually located on the device). Such CNC systems can provide end-to-end component design using computer-aided design (CAD) and computer-aided manufacturing (CAM) programs. These programs produce a computer file that is interpreted to extract the commands needed to operate a particular machine by use of a post processor, and then loaded into the CNC machines for production. Since any particular component might require the use of a number of different tools—drills, saws, etc.—modern machines often combine multiple tools into a single "cell". In other installations, a number of different machines are used with an external controller and human or robotic operators that move the component from machine to machine. In either case, the series of steps needed to produce any part is highly automated and produces a part that closely matches the original CAD design.

In any regard, machine motion is controlled along multiple axes, normally at least two (X and Y), and a tool spindle that moves in the Z (depth). The position of the tool is driven by direct-drive stepper motor or servo motors in order to provide highly accurate movements, or in older designs, motors through a series of step down gears. Open-loop control works as long as the forces are kept small enough and speeds are not too great. On commercial metalworking machines, closed loop controls are standard and required in order to provide the accuracy, speed, and repeatability demanded. CNC can include laser cutting, welding, friction stir welding, ultrasonic welding, flame and plasma cutting, bending, spinning, hole-punching, pinning, gluing, fabric cutting, sewing, tape and fiber placement, routing, picking and placing, and sawing.

Alternatively, flexible curvilinear knife 500 could be manufactured from multiple materials in order to utilize the unique physical characteristics of the material forming each part of the flexible curvilinear knife 500 (i.e., cutting element 510, blade holder element 530, and/or spring elements 525). By way of non-limiting example, cutting element 510 can be formed from a first material having a first set of material properties and spring elements 525 can be formed from a second material having a second set of material properties. Alternatively, each spring element 525 of the plurality of spring elements 520 can be formed from materials having differing material properties in order to provide a differential flexural modulus to a respective portion of cutting element 510. Still further, blade holder element 530 (or portions thereof) can be formed from a first material having a first set of material properties and spring elements 525 can be formed from a second material having a second set of material properties.

In still yet another non-limiting example, each portion of the flexible curvilinear knife 500 could be fabricated separately and combined into a final flexible curvilinear knife 500 assembly. In other words, the cutting element 510, blade holder element 530, and each of the plurality of spring elements 520 could be fabricated separately and combined by an assembler to form a final flexible curvilinear knife 500. This can facilitate assembly and repair work to the parts of the flexible curvilinear knife 500 such as coating, machining, heating and the like, etc. before they are assembled together to make a complete flexible curvilinear knife 500. In such techniques, two or more of the components of flexible curvilinear knife 500 commensurate in scope with the instant disclosure can be combined into a single integrated part. By way of non-limiting example, the flexible curvilinear knife 500 having a cutting element 510, blade holder element 530, and each of the plurality of spring elements 520 can be fabricated as an integral component.

Such construction can provide an efficient form for forming the required knife edge 540 in order to facilitate the cutting of a web material when the knife edge 540 of flexible curvilinear knife 500 is in contacting and mating engagement with an anvil opposed thereto.

Alternatively, and by way of another non-limiting example, the flexible curvilinear knife 500 could similarly be constructed as a uni-body structure where knife edge 540 is manufactured in situ and includes any required structure that is, or is desired to be, integral with cutting element 510. This can include, by way of non-limiting example, discontinuities in knife edge 540 required to form a perforation blade suitable for perforating personal absorbent products such as bath tissue and paper toweling, a desired camber or chamfer desired for knife edge 540, multiple (spaced) knife edges 540 disposed upon cutting element 510, or a desired geometry for knife edge 540.

One of skill in the art could model the particular blade shapes, spring shapes, physical design elements, material characteristics, and the like to provide the desired characteristics of the of the blade and spring(s) of the flexible curvilinear blade using numerous modeling techniques including, but not limited to, finite element analysis (FEA). Such an analysis tool can be used to provide for virtually any design of linear or curvilinear blades necessary for the web cutting operation envisioned by the present disclosure. This can include, but is clearly not limited to, any combination of spring shapes, spring positioning relative to the blade and blade holder, and orientation.

Figure 18:
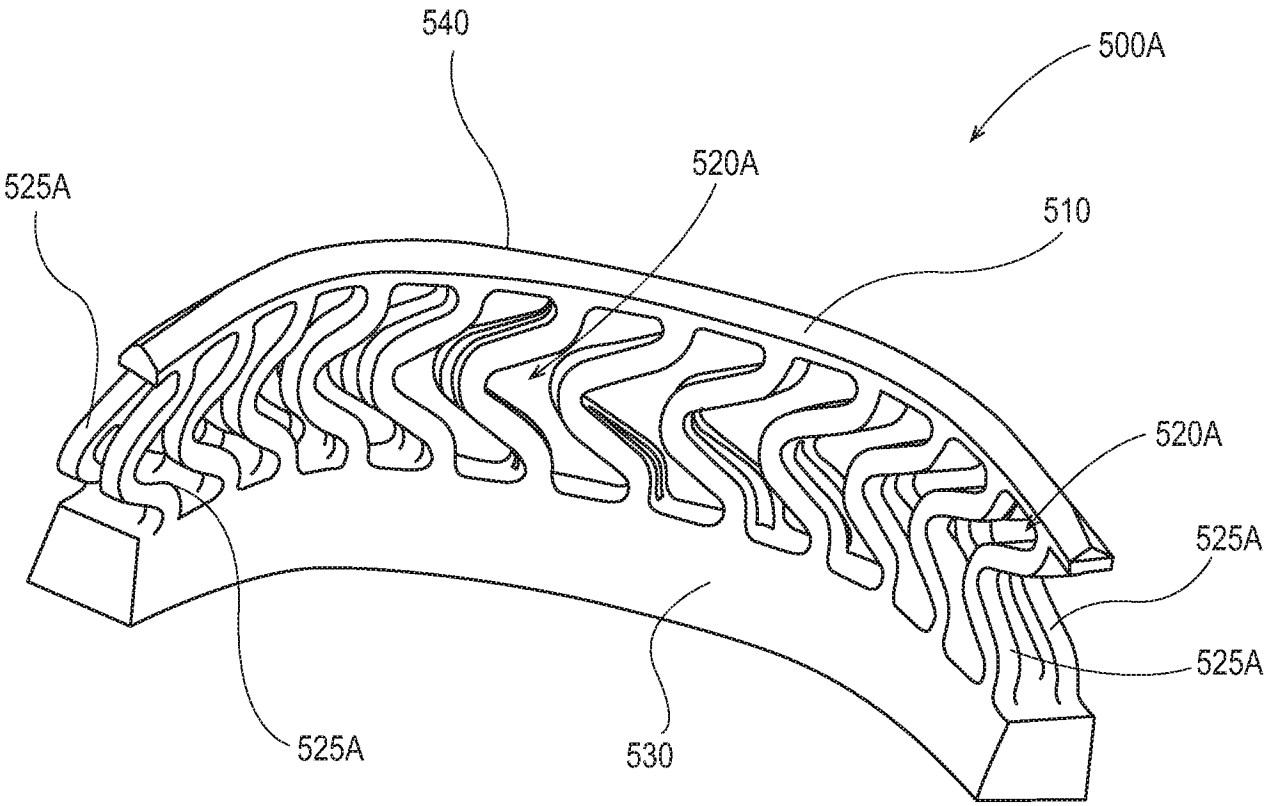
FIG. 18 is a perspective view of an alternative embodiment of an exemplary flexible curvilinear knife of the present disclosure.
Figure 19:
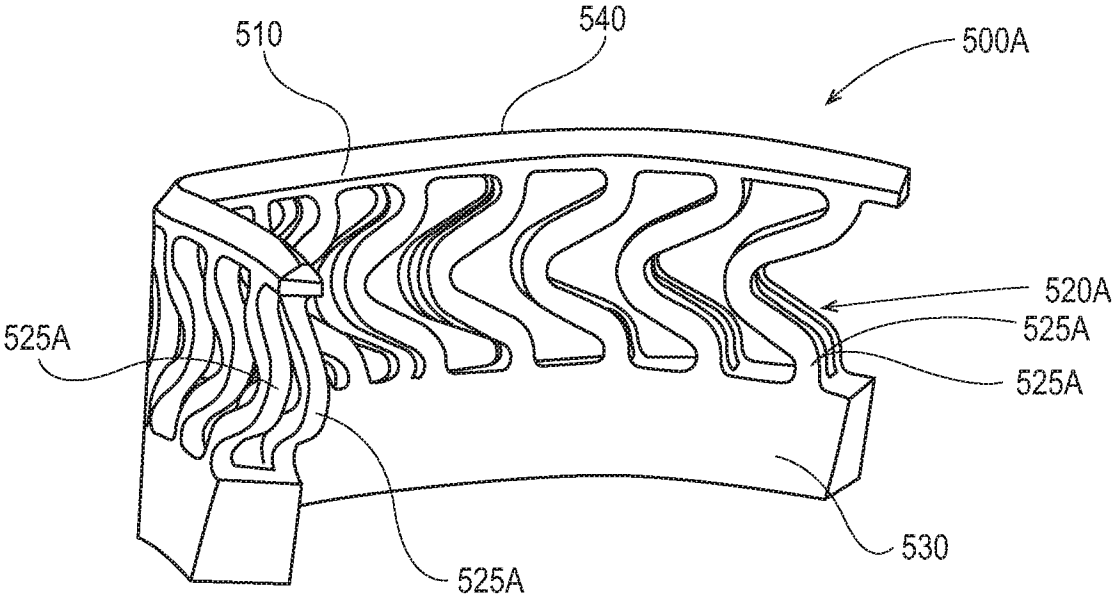
FIG. 19 is another perspective view of the exemplary flexible curvilinear knife FIG. 18.

As shown in FIG. 18-19, an alternative embodiment for a flexible curvilinear knife 500A can be formed from essentially three elements. Flexible curvilinear knife 500 can be formed from a cutting element 510 and a blade holder element 530. Cutting element 510 is operatively conjoined and connected to blade holder element 530 by a plurality of spring elements 520A arranged as pairs of spring elements 525A. Each spring element of a pair of spring elements 525A of the plurality of spring elements 520A can be operatively connected at a proximal end to be operably and fixably attached to a desired discrete location of cutting element 510 and a distal end of each spring element of a pair of spring elements 525A of the plurality of spring elements 520A can be operably and fixably attached to a desired discrete location of blade holder element 530. In this arrangement, a first spring element of a pair of spring elements 525A can deflect in a first direction in a first combination of the MD, CD, and/or Z-directions relative to blade holder 530 and a second spring element of a pair of spring elements 525A can deflect in a second direction in a second combination of the MD, CD, and/or Z-directions relative to blade holder 530. This can acceptably accommodate any torsional forces applied to and experienced by cutting element 510 relative to blade holder 530 when flexible curvilinear knife 500A is engaged with an opposed anvil.

Stated another way, it is believed that providing the plurality of spring elements 520A as arranged pairs of spring elements 525A can facilitate the deflection of cutting element 510 into any desired combination of the MD, CD, and/or Z-directions. Since flexible curvilinear knife 500 is designed to be disposed in contacting engagement with an opposed anvil in rotary fashion with a web material disposed therebetween, one of skill in the art will likely appreciate that the forces disposed upon cutting element 510 by an opposed anvil and any web material disposed therebetween may not be solely limited to forces disposed orthogonal to flexible curvilinear knife 500A (i.e., in the Z-direction). Therefore, providing flexible curvilinear knife 500A with an ability to have cutting element 510 operatively associated thereto with the possibility for 3-dimensional movement due to the individual flexion provided by each spring element of a given pair of spring elements 525A can reduce any wear caused by repeated out-of-plane deformation of the cutting element 510 of flexible curvilinear knife 500A that can result in rapid degradation of the cutting surface of cutting element 510. Additionally, without desiring to be bound by theory, it is believed that providing flexible curvilinear knife 500A with an ability to have cutting element 510 operatively associated thereto with the possibility for 3-dimensional movement due to the individual flexion provided by each spring element of a given pair of spring elements 525A can reduce material fatigue in the flexible curvilinear knife 500A or in cutting element 510 itself due to repeated out-of-plane deformation.

As stated supra, one of skill in the art will appreciate that knife edge 540 can be provided as a single, elongate blade suitable for providing continuous curvilinear cuts for elongate web materials suitable for the formation of assembled products such as diapers, catamenial devices and adult incontinence articles. Alternatively, one of skill in the art will appreciate that knife edge 540 can be provided as plurality of discrete blade segments suitable for perforating elongate web materials suitable for the formation of consumer products such as bath tissue and paper toweling. Without desiring to be bound by theory, it is believed that each spring element of a given pair of spring elements 525A can be a linear spring (i.e., obeys Hooke's law) or a non-linear spring, (i.e., does not obey Hooke's law).

Figure 20:
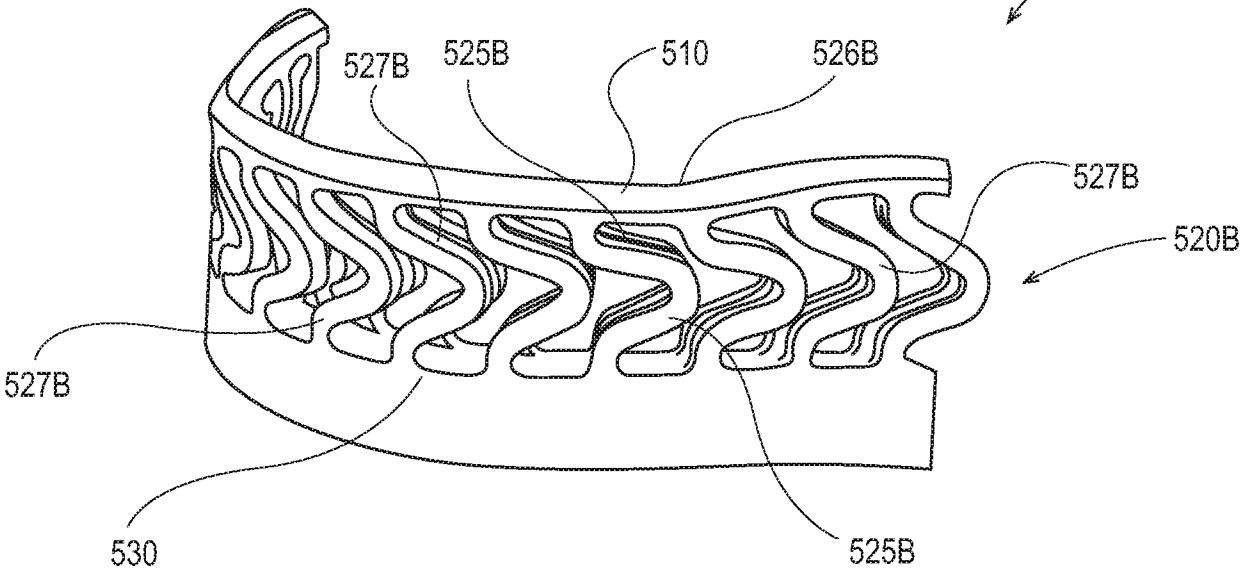
FIG. 20 is a perspective view of the exemplary flexible curvilinear knife of FIG. 18 as would appear when the flexible curvilinear knife of FIG. 18 engages an anvil when a web material is disposed therebetween showing a localized deformation within the cutting element relative to the blade holder element and where the deformation within the cutting element causes a contraction within at least one spring element proximate to the localized deformation and operatively connected to and disposed between the cutting element and blade holder.

As can be seen in FIG. 20, localized deformation within the cutting element 510 causes a contraction within at least one spring element of a first pair of spring elements 525B disposed proximate to the localized deformation 526B. Regions of the cutting element 510 disposed adjacent the localized deformation are not so deformed. The spring elements of a second pair of spring elements 527B located adjacent the at least one spring element of a first pair of spring elements 525B disposed proximate to the localized deformation 526B are not compressed or are compressed to a lesser degree than the at least one spring element of a first pair of spring elements 525B disposed proximate to the localized deformation 526B according to the spring constant, k, associated with each respective spring element of the plurality of spring elements 520B. Each spring element of the first pair of spring elements 525B disposed proximate to the localized deformation 526B can deflect in any combination of the MD, CD, and/or Z-directions in order to reduce the forces (e.g., torsional, stress, strain, etc.) induced in cutting element 510 caused by the engagement of flexible curvilinear knife 500A with an opposed anvil.

Figure 21:
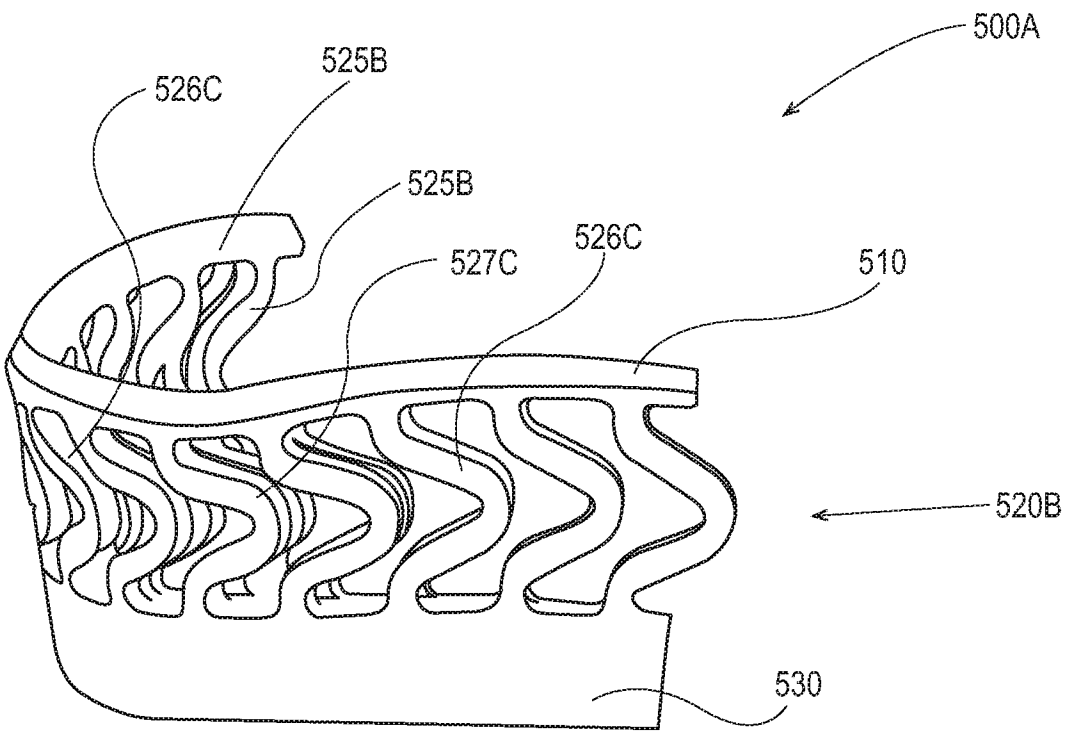
FIG. 21 is a perspective view of the exemplary flexible curvilinear knife of FIG. 18 as would appear when the flexible curvilinear knife of FIG. 18 engages an anvil when a web material is disposed therebetween showing another localized deformation within the cutting element relative to the blade holder element and where the deformation within the cutting element causes a contraction within at least another one spring element proximate to the new localized deformation and operatively connected to and disposed between the cutting element and blade holder; and, FIG. 22 is a perspective view of yet another alternative embodiment of an exemplary flexible curvilinear knife of the present disclosure.

As can be seen in FIG. 21, as the first portion of the flexible curvilinear knife 500A engaged with an anvil disengages and a second portion of the exemplary flexible curvilinear knife 500A engages the anvil when a web material is disposed therebetween a second localized deformation within the cutting element 510 relative to the blade holder 530 occurs. This second localized deformation within the cutting element 510 causes a contraction within at least one spring element of a first pair of spring elements 525B proximate to the localized deformation 526C and operatively connected to and disposed between the cutting element 510 and blade holder 530. When the second localized deformation within the cutting element 510 occurs, regions of cutting element 510 disposed adjacent the second localized deformation 526C are not so deformed. It is believed that the spring elements of a pair of spring elements 527C located adjacent the localized deformation 526C are not compressed, or alternatively, are compressed to a lesser degree than the at least one spring element of a pair of spring elements 525B disposed proximate to the localized deformation 526C according to the spring constant, k, associated with each respective spring element of a pair of spring elements 525B of the plurality of spring elements 520. Thus, it is believed to be surprisingly advantageous to provide each spring element of a pair of spring elements 525B of the plurality of spring elements 520B to be provided with a spring constant, k, suitable and necessary for the cutting operation for which the flexible curvilinear knife 500A will be used.

Figure 22:
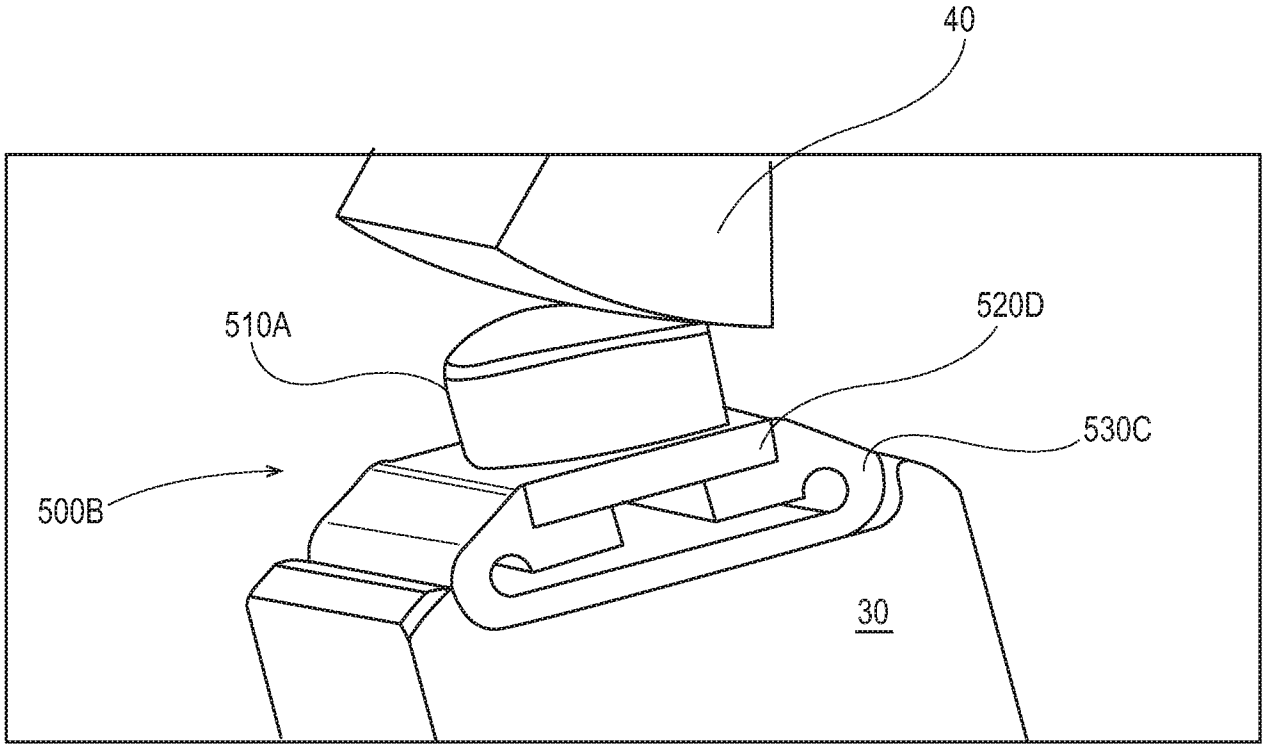

An alternative embodiment of a flexible curvilinear knife 500B formed from essentially three elements is provided in FIG. 22. Flexible curvilinear knife 500B can be formed from a cutting element 510A and a blade holder element 530C. Cutting element 510A is operatively conjoined and connected to blade holder element 530C by a spring element 520D.

As shown, cutting element 510A is disposed upon a surface of spring element 520D. Spring element 520D and blade holder element 530C are effectively disposed within a cavity of rotary press 30. An external surface of blade holder element 530C can be provided with a geometry that facilitates placement of spring element 520D therein. Further, blade holder element 530C can be provided with a geometry that facilitates movement of either or both of cutting element 510A and spring element 520D due to compressionary forces exerted upon cutting element 510A by rotary anvil 40. In other words, as rotary anvil 40 contacts cutting element 510A and any web material disposed therebetween, rotary anvil 40 caused cutting element 510A to deflect away from rotary anvil 40 in a direction generally orthogonal to cutting element 510A. The movement of cutting element 510 away from rotary anvil 40 causes cutting element 510A to deflect into the surface of spring element 520D. Deflection of cutting element 510A into the surface of spring element 520D can cause elements of blade holder element 530C to deflect relative to rotary anvil 40 in any combination of the MD, CD, and Z-directions as may be required to have cutting element 510A operatively associated thereto with the possibility for 3-dimensional movement due to the individual flexion provided by any of spring element 520D and blade holder element 530C to reduce any wear caused by repeated out-of-plane deformation of the cutting element 510A of flexible curvilinear knife 500B that can result in rapid degradation of the cutting surface of cutting element 510A. Additionally, without desiring to be bound by theory, it is believed that providing flexible curvilinear knife 500B with an ability to have cutting element 510A operatively associated thereto with the possibility for 3-dimensional movement due to the flexion provided by any of element 520D and blade holder element 530C can reduce material fatigue in the flexible curvilinear knife 500B or in cutting element 510A itself due to repeated out-of-plane deformation.

Without desiring to be bound by theory, it is believed that spring element 520D can be formed from a material to provide spring element 520D as a linear spring (i.e., obeys Hooke's law) or a non-linear spring, (i.e., does not obey Hooke's law). Therefore, it should be understood and appreciated by one of skill in the art that a suitable spring element 520D suitable for use in the flexible curvilinear knife 500B can be formed from any material and can include all springs, no matter the design or shape that obey, or do not obey, Hooke's law. Further, it should be understood and appreciated by one of skill in the art that spring element 520D any region thereof can comprise any combination of linear and non-linear spring regions can be suitable for use in the flexible curvilinear knife 500B. This can provide the desired degree of localized deformation for the cutting element 510A of flexible curvilinear knife 500B.

It is believed that each region of spring element 520D can be provided with an individualized spring constant, k. Alternatively, it is believed that each region of spring element 520D can be provided with the same spring constant, k. In other words, a first region of spring element 520D can be provided with a first spring constant, $k_1$, and a second region of spring element 520D can be provided with a second spring constant, $k_2$. The first spring constant, $k_1$, can be different from the second spring constant, $k_2$ (e.g., the first spring constant, $k_1$, can be less than the second spring constant, $k_2$, or the first spring constant, $k_1$, can be greater than the second spring constant, $k_2$). A benefit of the present flexible curvilinear knife 500 can be realized by providing each region of the cutting element 510A of flexible curvilinear knife 500B with the ability to have a localized, discrete, flexural modulus thereby increasing the operable lifetime of the flexible curvilinear knife 500B, reducing potential catastrophic degradation of the flexible curvilinear knife 500B, and reducing the overall set-up time of a web cutting operation by allowing the operator to place the knife/anvil system in a position without an exacting degree of accuracy in order to establish the required interference between the blade and anvil of the manufacturing system. It is believed that current manufacturing techniques require an interference on the order of 1.0 μM to 9.0 μM in order to effectively cut a web material for use as an assembled product such as a diaper, catamenial device, or adult incontinence article. It is believed that the current flexible knife design described herein could facilitate the need for a lesser degree of interference between the cutting edge of the knife and the opposed anvil on the order of 10 μM to 100 μM. One of skill in the art will readily appreciate that knife design of the present disclosure will clearly reduce the set-up time of the requisite interference since it is believed that the springs of the described knife design will accommodate any overcompensation of an operator in setting the knife too close to the opposed anvil resulting in the catastrophic events described supra.

It is believed that if each region of spring element 520D is provided with the ability to have a localized, discrete, flexural modulus, a localized deformation within the spring element 520D relative to the blade holder 530 can occur. When this localized deformation occurs, regions of spring element 520D disposed adjacent the localized deformation may not be so deformed. It is also believed that the region of spring element 520D located adjacent a localized deformation is not compressed, or alternatively, is compressed to a lesser degree than the region of spring element 520D proximate to the localized deformation according to the spring constant, k, associated with each portion of spring element 520D. To facilitate a differential deformation within the spring element 520D, it may be advantageous for a first portion of the spring element 520D to be formed from a first material and a second portion of the spring element 520D from a second material. The first and second materials forming the spring element 520D can be different. Alternatively, it may be advantageous each portion of the spring element 520D to be formed from the same material.

All publications, patent applications, and issued patents mentioned herein are hereby incorporated in their entirety by reference. Citation of any reference is not an admission regarding any determination as to its availability as prior art to the claimed invention.

The dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible curvilinear knife comprising:

a cutting element that is curvilinear in a lengthwise direction, a blade holder element, and, a plurality of pairs of sinusoidal spring elements separated by gaps between adjacent pairs of said spring elements;

wherein a first, proximal end of each sinusoidal spring element of said plurality of pairs of spring elements is operably and fixably attached to a discrete location of said cutting element and a second, distal end of each spring element of said plurality of pairs of sinusoidal spring elements is fixably attached to a discrete location of said blade holder element wherein said plurality of pairs of sinusoidal spring elements are aligned in tandem along said lengthwise direction.

2. The flexible curvilinear knife of claim 1 wherein a first spring element of said plurality of pairs of spring elements is provided with a first spring constant, $k_1$, and a second spring element of pairs of said plurality of spring elements is provided with a second spring constant, $k_2$, said first spring constant, $k_1$, and said second spring constant, $k_2$, being different.

3. The flexible curvilinear knife of claim 2 wherein said first and second spring elements of said plurality of pairs of spring elements are disposed adjacent one another when said first and second spring elements of said plurality of pairs of spring elements are operably and fixably attached to said cutting element and said blade holder element.

4. The flexible curvilinear knife of claim 1 wherein a first spring element of said plurality of pairs of spring elements is provided with a first spring constant, $k_1$, and a second spring element of said plurality of pairs of spring elements is provided with a second spring constant, $k_2$, said first spring constant, $k_1$, and said second spring constant, $k_2$, being the same.

5. The flexible curvilinear knife of claim 1 wherein each spring element of said plurality of pairs of spring elements produces forces that vary non-linearly with displacement.

6. The flexible curvilinear knife of claim 1 wherein a localized deformation within said cutting element causes a contraction within at least one spring element disposed proximate to said localized deformation said cutting element.

7. The flexible curvilinear knife of claim 1 wherein each spring element of said plurality of pairs of spring elements provides a discrete flexural modulus for each portion of said cutting element.

8. The flexible curvilinear knife of claim 1 wherein a first portion of said flexible curvilinear knife has a first localized deformation when contactingly engaged with an anvil and a second portion of said flexible curvilinear knife has a second localized deformation when contactingly engaged with said anvil.

9. The flexible curvilinear knife of claim 1 wherein each spring element of the plurality of pairs of spring elements is provided with an individualized spring constant, k.

* * * * *